US007263861B2

(12) United States Patent
Yabuuchi et al.

(10) Patent No.: US 7,263,861 B2
(45) Date of Patent: Sep. 4, 2007

(54) WASHING AND DRYING MACHINE

(75) Inventors: Hidetaka Yabuuchi, Hyogo (JP); Shigeharu Nakamoto, Hyogo (JP); Mikio Tahara, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 559 days.

(21) Appl. No.: 10/684,462

(22) Filed: Oct. 15, 2003

(65) Prior Publication Data

US 2004/0079121 A1 Apr. 29, 2004

(30) Foreign Application Priority Data

Oct. 16, 2002 (JP) ..... 2002-301600
Aug. 7, 2003 (JP) ..... 2003-288700
Aug. 7, 2003 (JP) ..... 2003-288701

(51) Int. Cl.
*D06F 25/00* (2006.01)

(52) U.S. Cl. ..... 68/12.15; 68/19.2; 68/20; 68/24

(58) Field of Classification Search ..... 68/12.14, 68/12.15, 19, 19.1, 19.2, 20, 23 R, 24
See application file for complete search history.

(56) References Cited

U.S. PATENT DOCUMENTS 5,887,456 A * 3/1999 Tanigawa et al. ..... 68/20
6,032,494 A * 3/2000 Tanigawa et al. ..... 68/12.06
6,282,928 B1 * 9/2001 Fukumoto et al. ..... 68/20
2003/0196277 A1 * 10/2003 Hallman et al. ..... 8/142

FOREIGN PATENT DOCUMENTS

| | | |
|---|---|---|
| DE | 4304372 | 8/1994 |
| EP | 0816548 | 1/1998 |
| GB | 2248920 | 4/1992 |
| JP | 64-32893 | 2/1989 |
| JP | 1032893 | 2/1989 |
| JP | 7-178289 | 7/1995 |
| JP | 7178289 | 7/1995 |
| JP | 7-289787 | 11/1995 |
| JP | 8-5245 | 1/1996 |
| JP | 9-056992 | 3/1997 |
| JP | 11-164996 | 6/1999 |
| JP | 11-253686 | 9/1999 |
| JP | 2001-343173 | 12/2001 |

* cited by examiner

*Primary Examiner*—Joseph L. Perrin
(74) *Attorney, Agent, or Firm*—Bacon & Thomas, PLLC

(57) ABSTRACT

A washing and drying machine of the present invention includes a water tub elastically supported in a housing; a rotary drum being rotatably mounted in the water tub; a heat pump having a compressor, a heat radiator, a throttle valve, a heat absorber, a pipework, and an air guide duct for guiding air to the heat absorber and the heat radiator; an air passageway provided to the water tub for allowing the air to flow into the rotary drum; a blower for forcing the air heated by the heat radiator to flow through the air passageway into the rotary drum; and a flexible connection member. The flexible connection member connects the air passageway to the air guide duct.

30 Claims, 18 Drawing Sheets

WASHING AND DRYING MACHINE

FIELD OF THE INVENTION

The present invention relates to a washing and drying machine which performs a washing operation, which includes washing, rinsing and dewatering cycles, and a drying operation in a same rotary drum.

BACKGROUND OF THE INVENTION

Referring to FIG. 18, there is illustrated a conventional washing and drying machine. Horizontally mounted in housing 1 of the machine is cylindrical water tub 3 which is elastically supported by a plural number of suspensions 2 absorbing vibration of water tub 3 during a washing operation. In water tub 3, cylindrical rotary drum. 5 for holding laundry articles 4 to be washed or dried (referred to as clothes hereinafter) is mounted horizontally and rotatably, which is rotated by rotator 6*a* of driving motor 6.

Mounted on an inner surface of rotary drum 5 are a plural number of baffles or vanes (not shown) for agitating clothes 4. A plurality of small openings 5*a* are formed in a cylindrical wall portion of rotary drum 5. Formed in a front wall of housing 1 is door opening 1*a* for loading and unloading clothes 4 in and from rotary drum 5, which is closed or opened by door 7. Mouth 3*a* of water tub 3 and mouth 5*b* of rotary drum 5 face door opening 1*a* of housing 1, mouth 3*a* of water tub 3 being connected watertightly to door opening 1*a* through bellows 8 attached therebetween. Formed on a lower portion of water tub 3 is drain 9 for allowing water therein to be drained, to which one end of drain hose 11 is connected through water outlet valve 10 disposed therebetween, while the other end of drain hose 11 is disposed to outside the machine.

Disposed in front of mouth 5*b* of rotary drum 5 is air injection opening 14 for allowing drying air heated by heater 13 to flow into rotary drum 5, the heated drying air being forced to flow by blower 12. Disposed beside driving motor 6 is circulation duct 15 for removing moisture from the drying air flowing out of rotary drum 5 and water tub 3, which has one end connected to air outlet 16 formed in the lower portion of water tub 3 and the other end connected to blower 12. Mounted behind water tub 3 is water inlet valve 17 for controlling flow of water supplied through water inlet hose 18.

Washing and drying operations of the aforementioned machine will now be described. Clothes 4 and detergent are placed in rotary drum 5 through door opening 1*a*, and then the machine is turned on. Water inlet valve 17 opens a passageway to water tub 3 to introduce water into water tub 3 and rotary drum 5. After a predetermined amount of water is supplied to water tub 3 and rotary drum 5, a washing cycle is performed, wherein driving motor 6 starts to rotate rotary drum 5. After a period of time, driving motor 6 is stopped and drain valve 10 is opened, so that used water is drained from rotary drum 5 and water tub 3 through drain hose 11 to the outside of the machine. Next, water tub 3 and rotary drum 5 are refilled with fresh water in a manner as mentioned above to initiate a rinsing cycle. After rinsing clothes, drain valve 10 is opened to drain water from rotary drum 5 and water tub 3. Then, rotary drum 5 is rotated by driving motor 6 to perform dewatering cycle for removing water from the clothes 4.

After the completion of the aforementioned washing operation, a drying operation is initiated. During the drying operation, rotary drum 5 is rotated at a low speed by driving motor 6 to tumble clothes 4, and air, forced to flow in a direction indicated by arrow 19 by blower 12, is heated by heater 13 and then introduced into rotary drum 5 through air injection opening 14. The heated air extracts moisture from the tumbling clothes 4 and then passes through openings 5*a*, water tub 3 and air outlet 16 to circulation duct 15.

At this time, water inlet valve 17 opens a passageway to circulation duct 15 to introduce water thereto. The water introduced into circulation duct 15 lowers temperature of the heated air containing moisture from clothes 4 to thereby condense the moisture. Then, thus dehumidified air is returned to blower 12. The cooling water and the resulting condensation are drained through drain valve 10 to the outside of the machine. Clothes 4 in rotary drum 5 are dried by forcing the heated air to flow through a circulation path made up of blower 12, heater 13, air injection opening 14, rotary drum 5, water tub 3, air outlet 16 and circulation duct 15.

In this conventional machine, most of heat used in drying clothes 4 is released into surroundings by the drained cooling water and condensation, and radiation of housing 1, without being reused.

Therefore, there has been proposed a drying machine employing a heat pump which is provided with a compressor for compressing coolant, a heat radiator for dissipating heat of the compressed coolant, a throttle valve for lowering pressure of the compressed coolant, a heat absorber for allowing the low-pressure coolant to absorb heat from ambient air and a pipework for allowing the coolant to circulate through the compressor, the heat radiator, the throttle valve and the heat absorber (see, for example, Japanese Patent Laid-open Publication No. 1999-178289).

However, the compressor, the heat radiator, the throttle valve and the heat absorber are connected by the pipework made of, e.g., copper, to circulate the coolant therethrough; and, therefore, if the heat pump experiences severe vibration, connection portions of the heat pump may be structurally weakened by the vibration or fatigue failure of the pipework may take place due to resonance. The washing and drying machine, compared to the drying machine performing only drying operation, provides the dewatering cycle during which rotary drum 5 rotates at a high speed thereby causing severe vibration of the machine. Further, since rotary drum 5 of the washing and drying machine has a horizontal rotational axis, rotational vibration of rotary drum 5 is stronger than that of a rotary drum having a vertical rotational axis. Therefore, it is essential to isolate the heat pump from the vibration of rotary drum.

SUMMARY OF THE INVENTION

It is, therefore, an object of the present invention to provide a washing and drying machine which is capable of improving reliability and durability by isolating a heat pump from vibration of a rotary drum.

In order to address the aforementioned problem, a washing and drying machine of the present invention is provided with a flexible connection member for connecting an air guide duct of the heat pump to an air passageway of a water tub.

In accordance with a first embodiment of the present invention, there is provided a washing and drying machine, including: a water tub elastically supported in a housing; a rotary drum for holding clothes, the rotary drum being rotatably mounted in the water tub; a heat pump including a compressor for compressing coolant, a heat radiator for dissipating heat of the compressed coolant, a throttle valve for lowering a pressure of the coolant, a heat absorber for allowing the coolant to absorb heat from surroundings, a pipework for allowing the coolant to circulate through the compressor, the heat radiator, the throttle valve and the heat absorber, and an air guide duct for guiding air to the heat absorber and the heat radiator; an air passageway provided to the water tub for allowing the air to flow into the rotary drum; a blower for forcing the air heated by the heat radiator to flow through the air passageway into the rotary drum; and a flexible connection member for connecting the air passageway to the air guide duct. Thus, vibration of the water tub is not transmitted directly to the heat pump, so that the heat pump is rarely affected by the vibration of the water tub. Consequently, reliability and durability of the machine are improved.

In accordance with a second embodiment of the present invention, there is provided the machine of the first embodiment, further including an air exhaust duct for allowing the air to flow out of the water tub, wherein the air guide duct includes a heat absorber duct for allowing the air to flow through the heat absorber and a heat radiator duct for allowing the air to flow through the heat radiator, the air passageway serves as an air supply duct for allowing the air to flow into the rotary drum, the air supply duct being connected to an outlet of the heat radiator duct through the flexible connection member, and the air exhaust duct is connected to an inlet of the heat absorber duct through another flexible connection member. Thus, although the machine is of a drying air circulating type, vibration of the water tub is not transmitted directly to the heat pump, so that the heat pump is rarely affected by the vibration of the water tub. Consequently, the reliability and durability of the machine are improved.

In accordance with a third embodiment of the present invention, there is provided the machine of the first embodiment, wherein the flexible connection member is made of a flexible hose. Thus, the flexible connection member is structurally simple and inexpensive.

In accordance with a fourth embodiment of the present invention, there is provided the machine of the first embodiment, further including a flexible air exhaust hose for allowing the air to flow out of the water tub, wherein the air guide duct includes a heat absorber duct for allowing the air to flow through the heat absorber and a heat radiator duct for allowing the air to flow through the heat radiator; the flexible connection member is a flexible air supply hose, the flexible air supply hose and the flexible air exhaust hose extending in a same direction; the flexible air supply hose is connected to an outlet of the heat radiator duct; and the flexible air exhaust hose is connected to an inlet of the heat absorber duct. Thus, vibration of the water tub is effectively isolated, so that the reliability and durability of the machine are improved.

In accordance with a fifth embodiment of the present invention, there is provided the machine of the fourth embodiment, wherein the flexible air supply hose and the flexible air exhaust hose extend parallel with each other. Thus, the flexible air supply hose and the flexible air exhaust hose are bent in a same vibration mode, so that they do not interfere with each other under vibration. In addition, endurance design can be readily made, so that the reliability and durability of the machine are improved.

In accordance with a sixth embodiment of the present invention, there is provided the machine of the first embodiment, wherein the flexible connection member is disposed under the water tub. In a front loading washing and drying machine, the water tub is generally disposed as high as possible to facilitate clothes loading and unloading. Thus, by disposing the heat pump at an empty space under the water tub and connecting the heat pump with the water tub through the flexible connection member, the length of the flexible connection member becomes shorter and the machine becomes more compact.

In accordance with a seventh embodiment of the present invention, there is provided the machine of the first embodiment, wherein the flexible connection member is disposed on the rear side of the water tub. In a front loading washing and drying machine, a rotational axis of the rotary drum slants with a mouth of rotary drum raised as high as possible to facilitate clothes loading and unloading. Thus, by disposing the flexible connection member under a rear portion of the water tub and connecting the heat pump with the water tub through the flexible connection member, the length of the flexible connection member becomes shorter and the machine becomes more compact.

In accordance with an eighth embodiment of the present invention, there is provided the machine of the first embodiment, wherein the flexible connection member is disposed above the water tub. The heat pump is often disposed above the water tub in order to prevent washing water from making incursion into the heat absorber and the heat radiator through the air supply. In such a case, by disposing the flexible connection member above the water tub and connecting the heat pump to the water tub through the flexible connection member, the length of the flexible connection member becomes shorter and the machine becomes more compact.

In accordance with a ninth embodiment of the present invention, there is provided the machine of the first embodiment, wherein the flexible connection member is disposed beside the water tub. When the heat pump is disposed on a left side or a right side of the water tub, the flexible connection member is disposed at a side portion of the water tub to connect the heat pump to the water tub, so that the length of the flexible connection member becomes shorter and the machine becomes more compact.

In accordance with a tenth embodiment of the present invention, there is provided the machine of the first embodiment, wherein the flexible connection member is removably attached between the air passageway and the air guide duct. Since the heat pump is separated from the water tub by decoupling the flexible connection member, the heat pump becomes a single separate unit. Thus, assembling process for manufacturing the heat pump and maintenance thereof can be readily preformed.

In accordance with an eleventh embodiment of the present invention, there is provided the machine of the tenth embodiment, wherein the flexible connection member is removably attached to the air guide duct. In repair and maintenance of the heat pump, the heat absorber and the heat radiator of the heat pump are readily exposed and inspected by decoupling the flexible connection member from the heat pump.

In accordance with a twelfth embodiment of the present invention, there is provided the machine of the tenth embodiment, wherein the flexible connection member is removably attached to the air passageway. Thus, inspection and maintenance of the air passageway of the water tub can be readily performed by decoupling the flexible connection member from the heat pump.

In accordance with a thirteenth embodiment of the present invention, there is provided the machine of the first embodiment, wherein the flexible connection member is expanded and contracted in a direction perpendicular to a rotational axis of the rotary drum. If the rotary drum is rotated with the clothes disposed therein eccentrically, the water tub vibrates severely in a direction perpendicular to a rotational axis of the rotary drum. Therefore, by disposing the flexible connection member in such a way that it can be expanded and contracted in a direction perpendicular to the rotational axis of the rotary drum, the vibration of the water tub can be effectively prevented from being transmitted to the heat pump. Further, in a front loading washing and drying machine, vertical position of the water tub is varied depending on the weight of water and clothes in the rotary drum. Therefore, by disposing the flexible connection member in such a way that it can be expanded and contracted in a direction perpendicular to the rotational axis, the flexible connection member can be readily expanded or contracted based on the vertical position of the water tub.

In accordance with a fourteenth embodiment of the present invention, there is provided the machine of the first embodiment, wherein the flexible connection member is expanded and contracted in a direction parallel to a rotational axis of the rotary drum. In the washing and drying machine having the vertically mounted rotary drum, a vertical vibration of water tub takes places due to vertical movement of clothes caused by agitation during the washing and drying operation. Thus, by disposing the flexible connection member so that it can be expanded and contracted along the rotational axis of the rotary drum, the vibration is effectively isolated. Further, in a top loading washing and drying machine, vertical position of the water tub is varied depending on the weight of water and clothes in the rotary drum. Therefore, by disposing the flexible connection member that can be expanded and contracted along the rotational axis, the flexible connection member can be readily expanded or contracted depending on the vertical position of the water tub.

In accordance with a fifteenth embodiment of the present invention, there is provided the machine of the first embodiment, wherein the heat pump is disposed under the water tub. The heat pump is installed in the housing without any large structural modification of a conventional machine. Thus, a compact and convenient washing and drying machine can be provided.

In accordance with a sixteenth embodiment of the present invention, there is provided the machine of the fifteenth embodiment, wherein the air guide duct is provided with a heat absorber duct for allowing the air to flow through the heat absorber and a heat radiator duct for allowing the air to flow through the heat radiator, the heat absorber duct and the heat radiator duct communicating with each other and being horizontally arranged so that the air flows straight therethrough. Thus, since the height of the heat pump is reduced, the machine becomes compact. As well since the loss in pressure of air flowing in the air guide duct becomes less, the capacity of the blower can be reduced.

In accordance with a seventeenth embodiment of the present invention, there is provided the machine of the fifteenth embodiment, wherein the air guide duct is provided with a heat absorber duct for allowing the air to flow through the heat absorber and a heat radiator duct for allowing the air to flow through the heat radiator, the heat absorber duct being arranged in a manner that the air flows downwards from an upper portion of the heat absorber to a lower portion of the heat absorber, and wherein a water exhaust opening for draining condensation is formed in a lower portion of the heat absorber duct. Thus, with the aid of air flowing downwards in the heat absorber duct, condensation formed by the heat absorber is effectively drained through the water exhaust opening formed in the lower portion of the heat absorber duct.

In accordance with an eighteenth embodiment of the present invention, there is provided the machine of the fifteenth embodiment, further including a mounting base for supporting the housing at a certain height, the mounting base accommodating therein the heat pump. Thus, since the heat pump is separated from the housing, it is rarely affected by the vibration of the housing. In addition, assembling process for manufacturing the machine and maintenance are readily performed.

In accordance with a nineteenth embodiment of the present invention, there is provided the machine of the first embodiment, wherein the blower is disposed in a corner portion where a top wall and a sidewall of the housing join together above the water tub. Thus, since a dead space in the housing is reduced, the machine becomes more compact.

In accordance with a twentieth embodiment of the present invention, there is provided the machine of the first embodiment, further comprising a filter for removing foreign matter from the air, the filter disposed in an upstream of the air flowing in the heat absorber duct. Thus, foreign matter such as lint produced during operation of the machine is prevented from being attached on fins of the heat absorber, a heat exchanger.

In accordance with a twenty first embodiment of the present invention, there is provided the machine of the first embodiment, wherein the air guide duct is provided with a heat absorber duct for allowing the air to flow through the heat absorber and a heat radiator duct for allowing the air to flow through the heat radiator, and wherein water supplied into the water tub during a washing operation is not remained in the heat absorber duct or the heat radiator duct after the completion of the washing operation. Thus, since corrosion in the heat absorber and heat radiator is prevented, the reliability and durability are improved.

In accordance with a twenty second embodiment of the present invention, there is provided the machine of the twenty first embodiment, further including an air exhaust duct for allowing the air to flow out of the water tub, the air exhaust duct being connected to an inlet of the air guide duct, wherein a portion of the air passageway and/or a portion of the air exhaust duct are/is located at a level higher than a water level of the water in the water tub. Thus, since corrosion in the heat absorber and heat radiator is prevented by keeping water from being introduced into the heat absorber duct or heat radiator duct, the reliability and durability are improved.

In accordance with a twenty third embodiment of the present invention, there is provided the machine of the twenty first embodiment, wherein the air guide duct is provided with a water exhaust opening for allowing water therein to be drained. Thus, since the water introduced into the air guide duct is drained through the water exhaust opening, corrosion in the heat absorber and the heat radiator is prevented, and the reliability and durability are improved.

In accordance with a twenty fourth embodiment of the present invention, there is provided the machine of the first embodiment, wherein the coolant includes a $CO_2$ gas as a main constituent. Thus, since a supercritical state is formed in the heat radiator, heated air of high temperature is obtained. Consequently, the heat radiator becomes more compact and effective.

In accordance with a twenty fifth embodiment of the present invention, there is provided the machine of the first embodiment, wherein a rotational axis of the rotary drum is disposed horizontal. In a front loading washing and drying machine, the direction of vibration of the water tub due to rotation of the rotary drum is identical to that of gravitation, so that the vibration of water tub becomes stronger. Therefore, by connecting the air passageway of the water tub to the heat pump through the flexible connection member, chances of vibration propagation from the water tub to the heat pump are substantially reduced, and thus, the reliability and durability are improved.

In accordance with a twenty sixth embodiment of the present invention, there is provided the machine of the first embodiment, wherein a rotational axis of the rotary drum is disposed vertical. In a top loading washing and drying machine, the vibration of the water tub is very complicated since it is a combination of horizontal vibration induced by the shaking of the rotary drum and vertical vibration induced by the vertical movement of the clothes and water in the rotary drum. Therefore, by connecting the air passageway to the heat pump through the flexible connection member, the chances of the vibration propagation from the water tub to the heat pump are effectively reduced, and thus, the reliability and durability are improved.

In accordance with a twenty seventh embodiment of the present invention, there is provided a washing and drying machine, including: a water tub elastically supported in a housing; a rotary drum for holding clothes, the rotary drum being rotatably mounted in the water tub; a heat pump including a compressor for compressing coolant, a heat radiator for dissipating heat of the compressed coolant, a throttle valve for lowering pressure of the coolant, a heat absorber for allowing the coolant to absorb heat, a pipework for allowing the coolant to circulate through the compressor, the heat radiator, the throttle valve, the heat absorber and an air guide duct for guiding air to the heat absorber and the heat radiator; a blower for forcing the air heated by the heat radiator to flow through an air passageway provided to the water tub into the rotary drum; an air supply duct for allowing the air to flow into the rotary drum; and an air exhaust duct for allowing the air to flow out of the water tub, wherein the air guide duct is provided with a heat radiator duct for allowing the air to flow through the heat radiator of the heat pump and a heat absorber duct for allowing the air to flow through the heat absorber of the heat pump; the air passageway is connected to an outlet of the heat radiator duct through a flexible connection member; and the air exhaust duct is connected to an inlet of the heat absorber duct through another flexible connection member. Therefore, since the vibration of the water tub is rarely transmitted to the heat pump, the heat pump in the housing is not affected by the vibration of the water tub. Consequently, the reliability and durability are improved.

In accordance with a twenty eighth embodiment of the present invention, there is provided a washing and drying machine, including: a water tub elastically supported in a housing; a rotary drum for holding clothes, the rotary drum being rotatably mounted in the water tub; a heat pump including a compressor for compressing coolant, a heat radiator for dissipating heat of the compressed coolant, a throttle valve for lowering pressure of the coolant, a heat absorber for allowing the coolant to absorb heat, a pipework for allowing the coolant to circulate through the compressor, the heat radiator, the throttle valve and the heat absorber, and an air guide duct for allowing air to flow through the heat absorber and the heat radiator of the heat pump; an air passageway provided to the water tub for allowing the air to flow into the rotary drum; and a blower for forcing the air heated by the heat radiator to flow through the air passageway into the rotary drum, wherein the air guide duct is connected to the air passageway through a flexible connection member, and water supplied into the water tub during a washing operation is not remained in the air guide duct after the completion of the washing operation. Therefore, the vibration of the water tub is rarely transmitted to the heat pump, so that the heat pump in the housing is not affected by the vibration of the water tub. In addition, the corrosion in the heat absorber and heat radiator is prevented. Consequently, the reliability and durability are improved.

In accordance with a twenty ninth embodiment of the present invention, there is provided a washing and drying machine, including: a water tub elastically supported in a housing; a rotary drum for holding clothes, the rotary drum being rotatably mounted in the water tub; a heat pump including a compressor for compressing coolant, a heat radiator for dissipating heat of the compressed coolant, a throttle valve for lowering pressure of the coolant, a heat absorber for allowing the coolant to absorb heat, a pipework for allowing the coolant to circulate through the compressor, the heat radiator, the throttle valve and the heat absorber, and an air guide duct for allowing air to flow through the heat absorber and the heat radiator of the heat pump; an air passageway provided to the water tub for allowing the air to flow into the rotary drum; and a blower for forcing the air heated by the heat radiator to flow through the air passageway into the rotary drum, wherein the air guide duct is connected to the air passageway through a flexible connection member, and the flexible connection member is removably attached between the air guide duct and the air passageway. Therefore, when the flexible connection member is decoupled from the heat pump, the heat pump becomes a single separate unit. Consequently, assembling process for manufacturing the machine, and repair and maintenance of the heat pump are readily performed.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1:
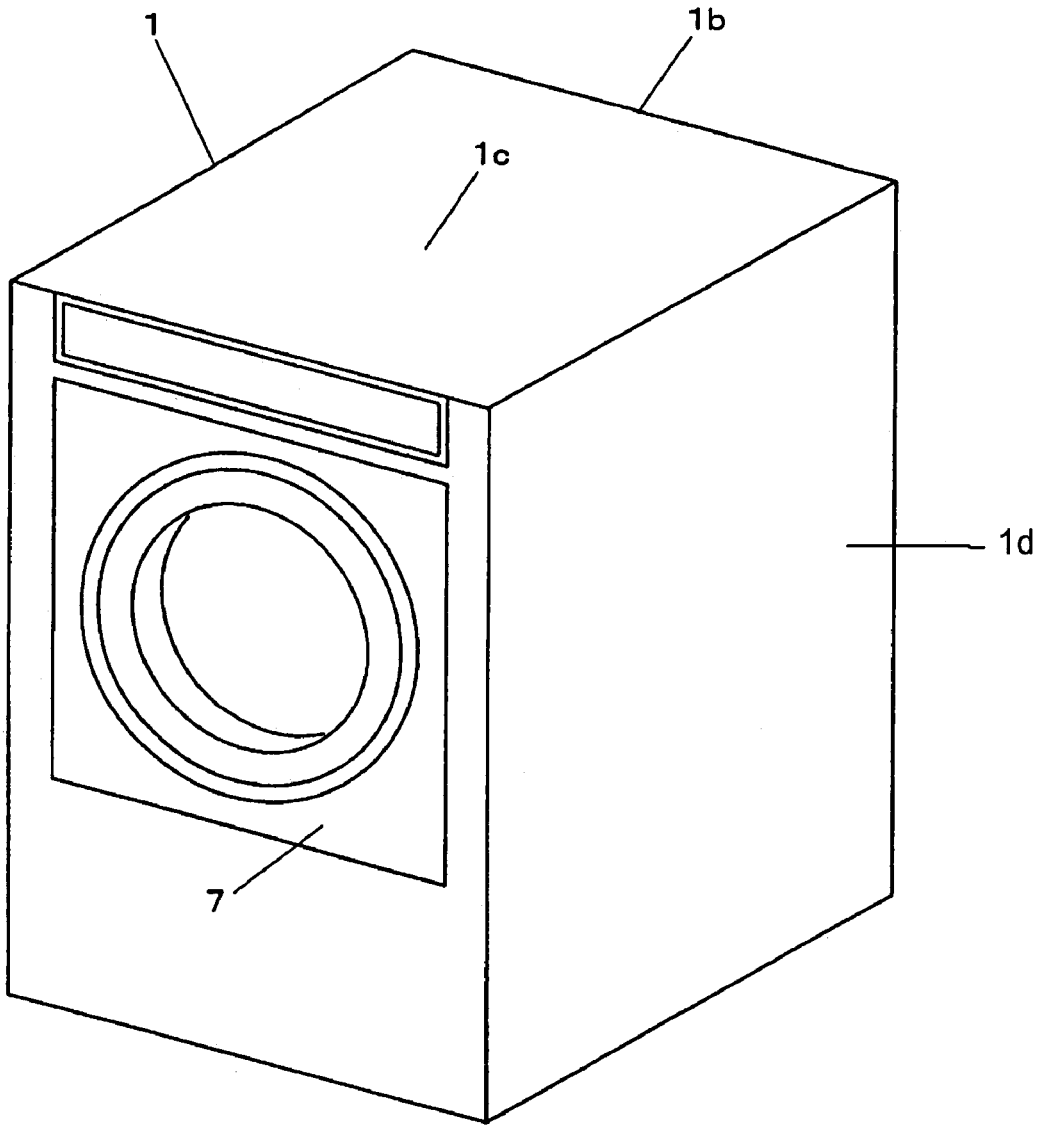
FIG. 1 is a perspective view of a washing and drying machine in accordance with a first embodiment of the present invention, showing its external appearance.

Embodiments of the present invention will now be described hereinafter with reference to FIGS. 1 to 17, wherein like parts to those of the prior art washing and drying machine are represented by like reference numerals, and detailed descriptions thereof will be omitted for simplicity.

Embodiment 1

Figure 2:
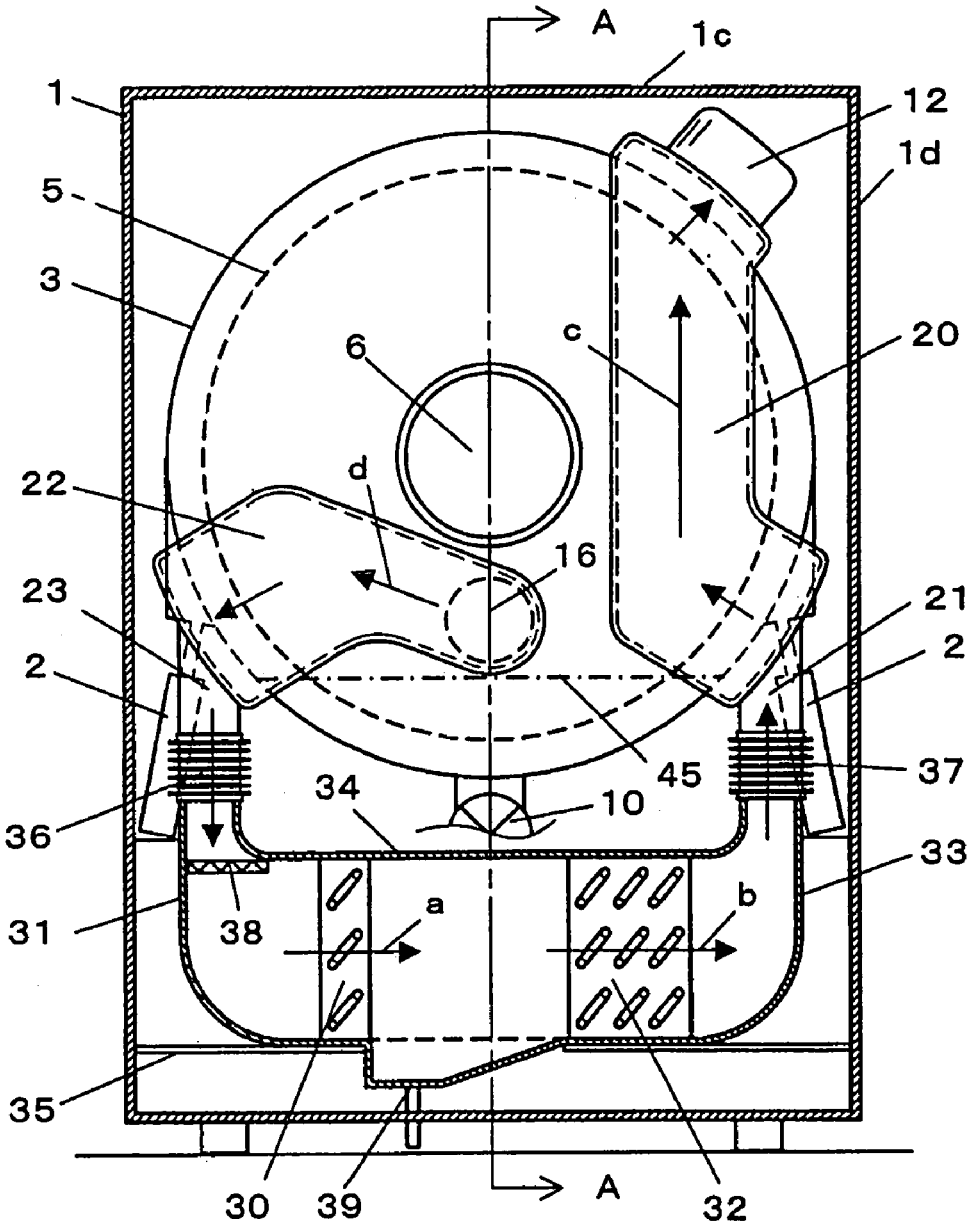
FIG. 2 presents a cross sectional view taken from rear wall 1*b* of FIG. 1.
Figure 3:
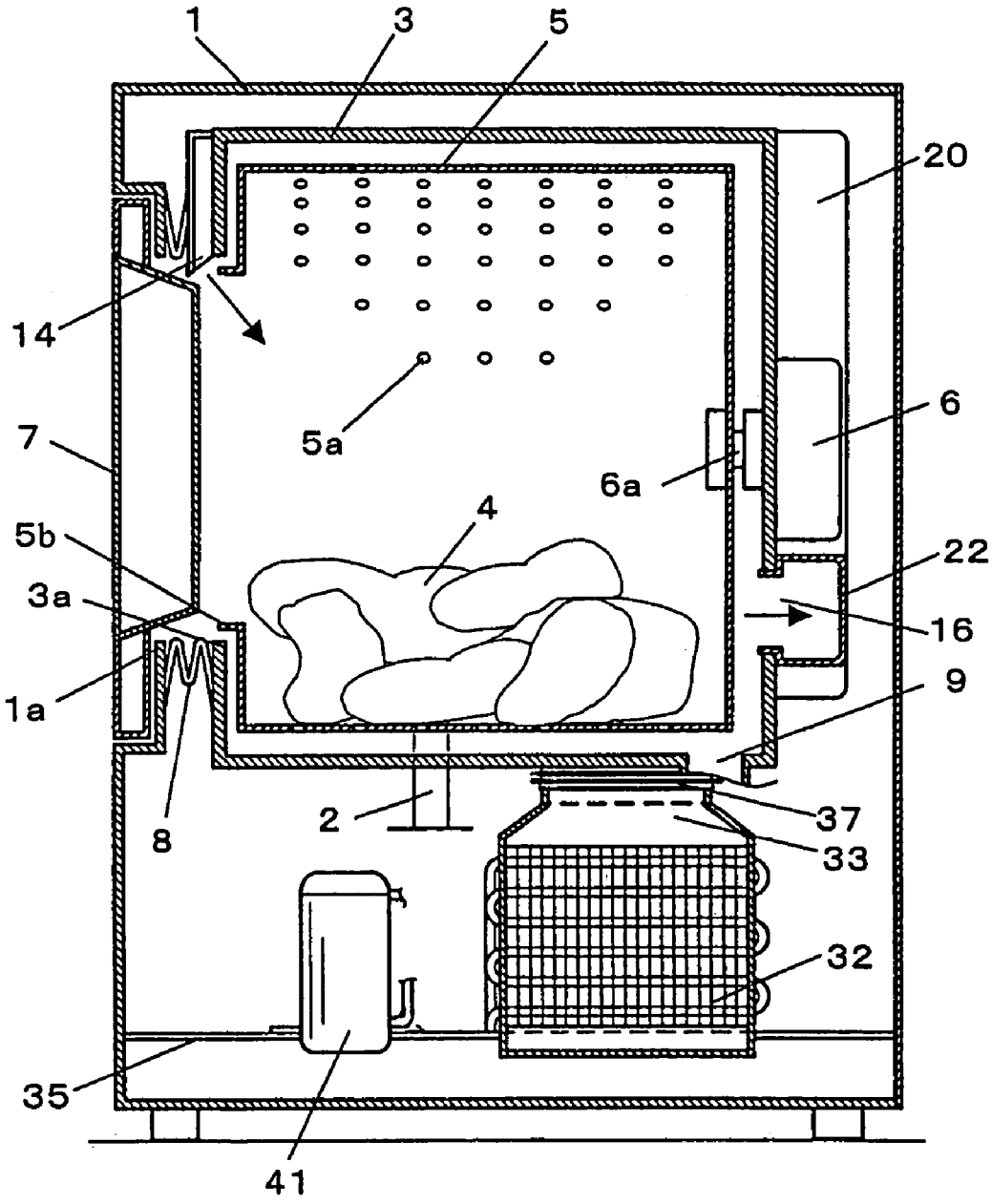
FIG. 3 depicts a cross sectional view taken along line A-A of FIG. 2.

FIG. 1 is a perspective view of a washing and drying machine in accordance with a first embodiment, showing external appearance; FIG. 2, a cross sectional view taken from rear wall 1*b* of housing 1; FIG. 3, a cross sectional view taken along line A-A of FIG. 2; and FIG. 4, a schematic diagram of drying operation of the washing and drying machine.

As shown in FIGS. 1 to 4, horizontally mounted in housing 1 is cylindrical water tub 3 which is elastically supported by a plural number of suspensions 2 absorbing vibration of water tub 3 during washing and dewatering cycles. In water tub 3, cylindrical rotary drum 5 for holding clothes 4 is mounted horizontally and rotatably, which is rotated by driving motor 6. Formed in a front wall of housing 1 is door opening 1*a* for loading and unloading clothes 4 into and from rotary drum 5, which is closed or opened by door 7. Mouth 3*a* of water tub 3 and mouth 5*b* of rotary drum 5 face opening 1*a* of housing 1, mouth 3*a* of water tub 3 being connected watertightly to opening 1*a* through bellows 8 attached therebetween. Formed on a lower portion of water tub 3 is drain 9 for allowing water in water tub 3 to be drained, which is connected to drain valve 10.

Blower 12, blowing means, is mounted at a corner portion where top wall 1*c* and sidewall 1*d* of housing 1 join together. Blower 12 communicates with air supply duct 20 disposed on the outer surface of water tub 3, and forces air introduced into air supply duct 20 from air supply duct inlet 21 to flow in a direction indicated by arrow c, so that the air is supplied to rotary drum 5 through air injection opening 14. Further, disposed on the outer surface of water tub 3 is air exhaust duct 22 communicating with air outlet 16 formed on a rear portion of water tub 3. The air supplied to rotary drum 5 passes through air outlet 16 of water tub 3 and flows in a direction of arrow d to air exhaust duct outlet 23.

Arranged horizontally under water tub 3 are heat absorber duct 31 for allowing air to flow in a direction of arrow a through heat absorber 30, one heat exchanger of a heat pump, and heat radiator duct 33 for allowing air to flow in a direction of arrow b through heat radiator 32, another heat exchanger of the heat pump. Heat absorber duct 31 and heat radiator duct 33 communicate with each other through connection duct 34 in a manner that air passing through heat absorber 30 flows straight to heat radiator 32.

Heat absorber duct 31, heat radiator duct 33 and connection duct 34 are formed in one body, and fixed to installation base 35 in housing 1. An inlet of heat absorber duct 31 and air exhaust duct outlet 23 communicate with each other through air exhaust hose 36 made of flexible material. Similarly, an outlet of heat radiator duct 33 and air supply duct inlet 21 communicate with each other through air supply hose 37 made of flexible material. Further, removably disposed at inlet portion in an upstream of heat absorber duct 31 is air cleaner 38 made of, e.g., synthetic fiber net, which serves as filtering means for removing particulates from the air. Further, water exhaust opening 39 is formed in a downstream portion of the lower wall of heat absorber duct 31.

Figure 4:
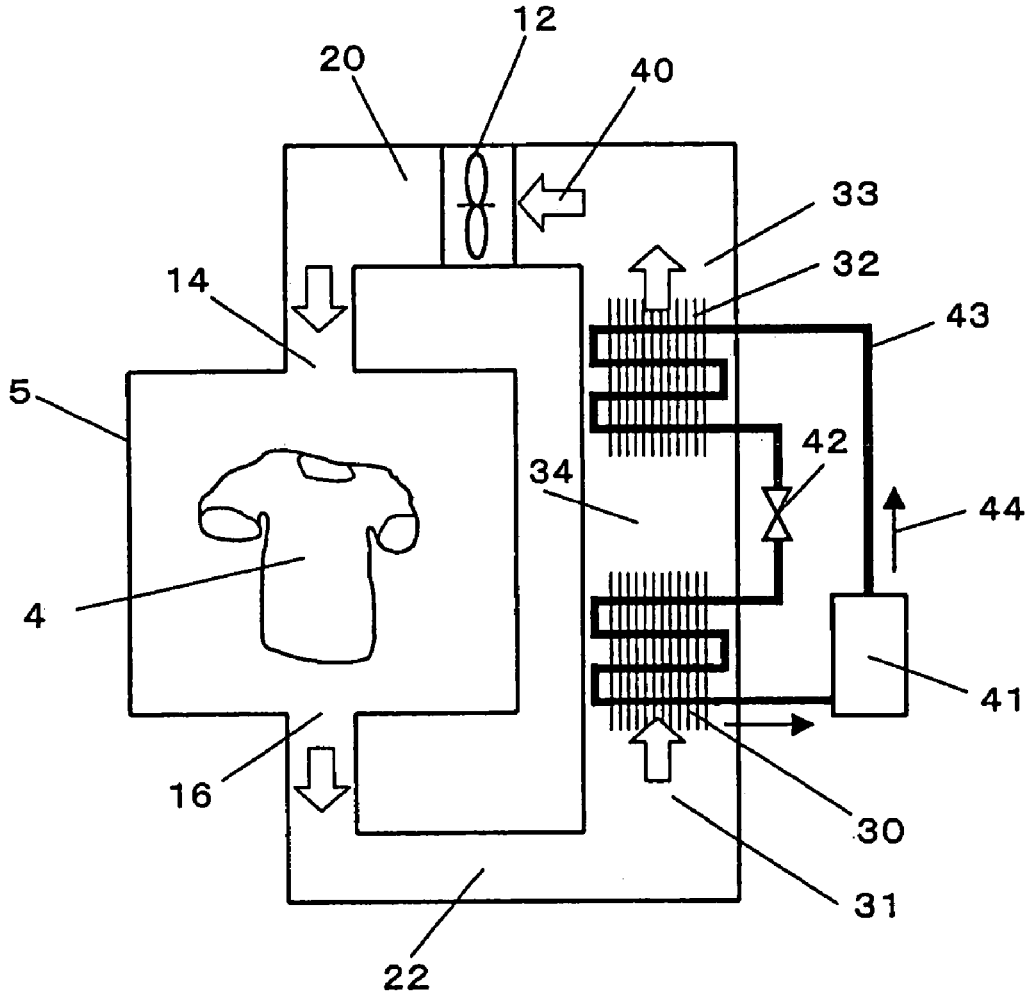
FIG. 4 offers a schematic diagram of drying operation of the washing and drying machine.
Figure 5:
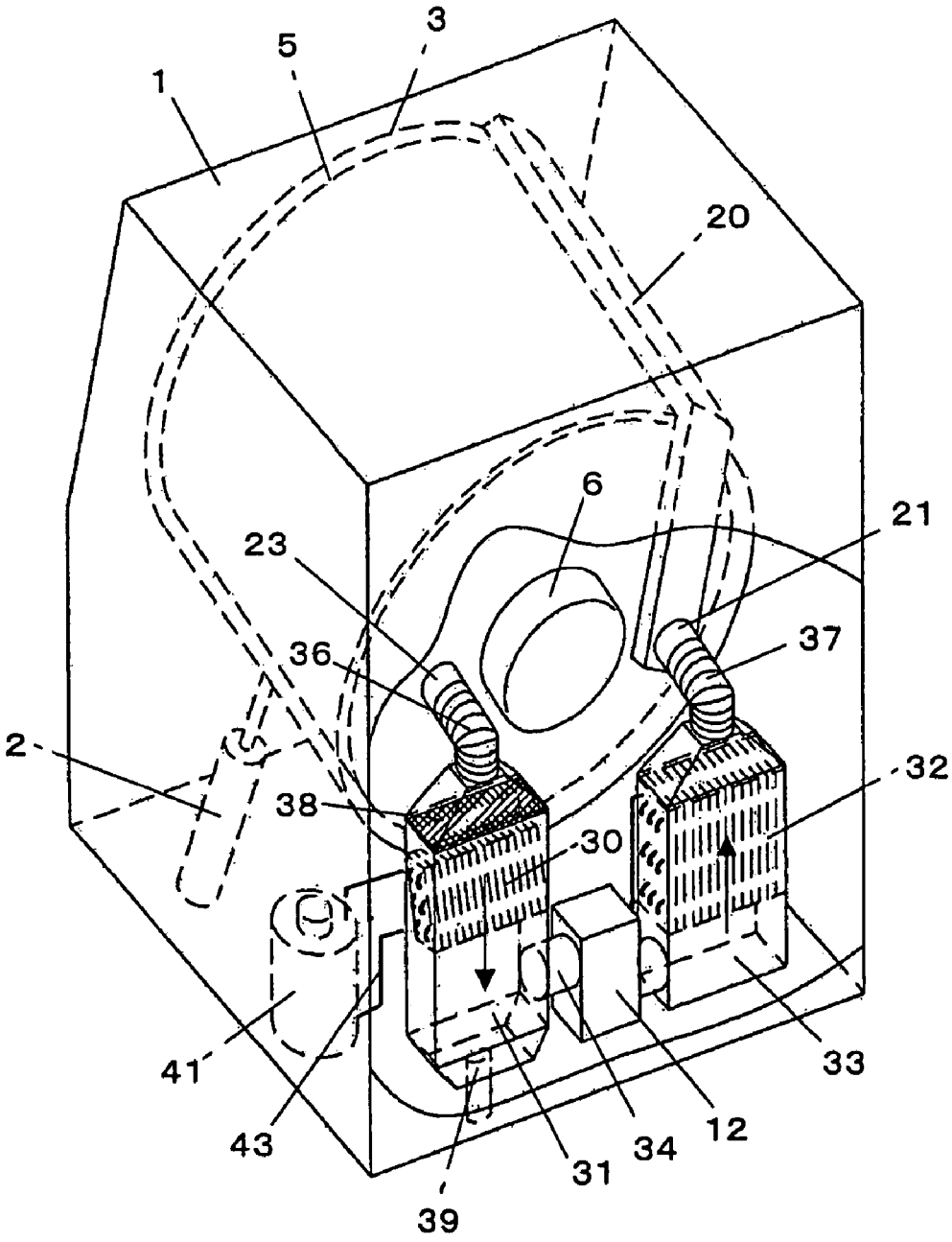
FIG. 5 sets forth a perspective view of a washing and drying machine in accordance with a second embodiment of the present invention with a portion thereof cutaway.
Figure 6:
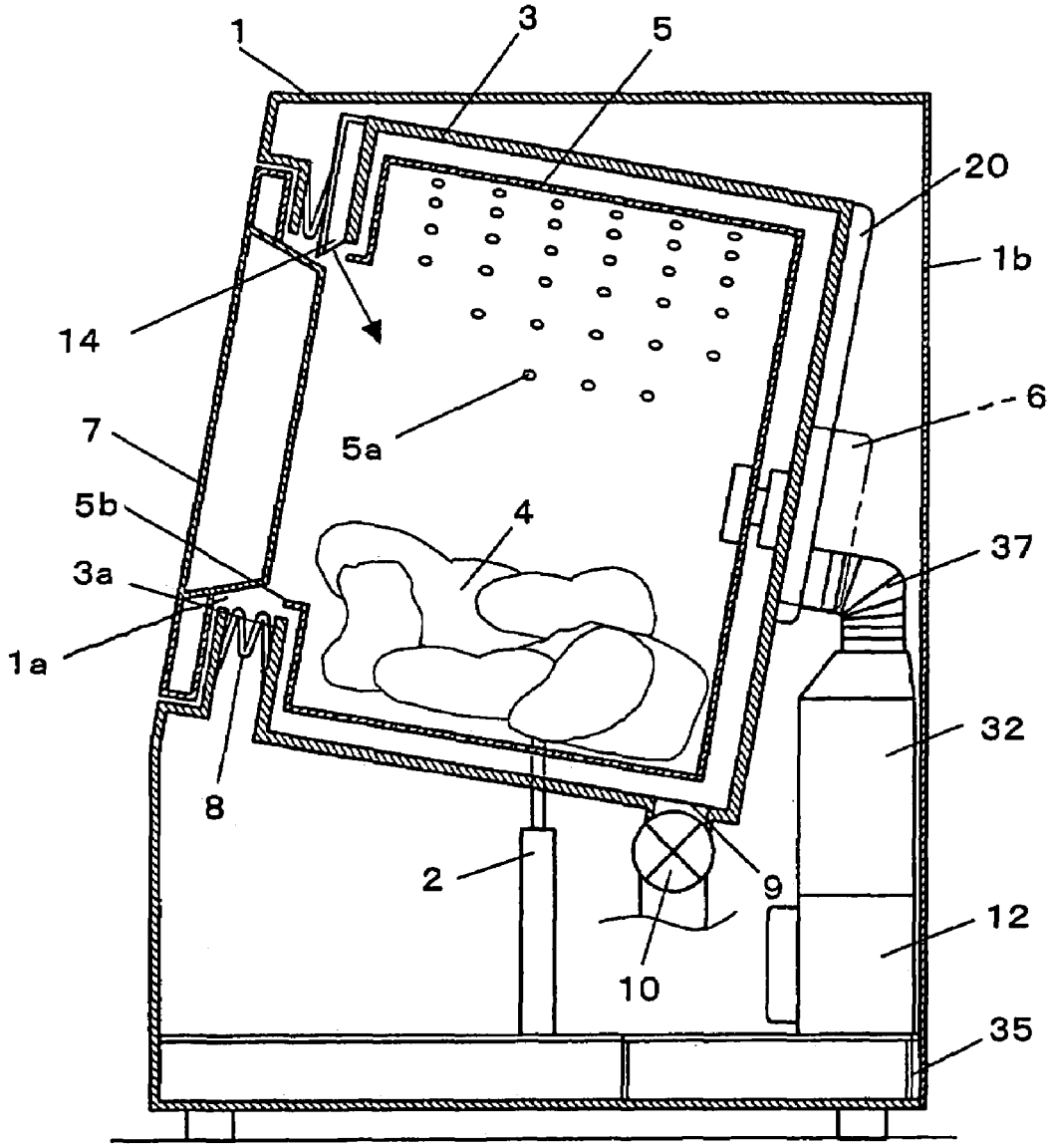
FIG. 6 releases a cross sectional view of the machine in accordance with the second embodiment.

As indicated by arrows 40 in FIG. 4, drying air forced to flow by blower 12 passes through air supply duct 20 and air injection opening 14 into rotary drum 5, flows through clothes 4 held in rotary drum 5, and then flows therefrom through air outlet 16. Next, the drying air passes through air exhaust duct 22, heat absorber 30 in heat absorber duct 31, connection duct 34 and heat radiator 32 in heat radiator duct 33 to blower 12.

Further, a heat pump is provided with compressor 41 for rendering coolant including, e.g., $CO_2$, as a main constituent to become a high-pressure coolant, heat radiator 32 for dissipating heat of the compressed coolant compressed by the compressor 41, throttle valve 42 for lowering pressure of the high-pressure coolant, heat absorber 30 for allowing the low-pressure coolant to absorb heat from surroundings and pipework 43 for allowing the coolant to circulate through compressor 41, heat radiator 32, throttle valve 42 and heat absorber 30. The coolant flows in a direction of arrow 44 to perform a heat pump cycle.

The operation of the aforementioned machine will now be described. In a washing cycle, water tub 3 is filled with water to a predetermined water level while drain valve 10 is closed, and rotary drum 5 containing clothes 4 and the water is rotated by driving motor 6 to wash clothes 4. At this time, in order to prevent a portion of the water introduced into air exhaust duct 22 from flowing into heat absorber 30, air exhaust duct 22 is configured in a manner that a portion of passageway defined by air exhaust duct 22 is lifted upward.

Further, during a rinsing cycle following the washing cycle, water tub 3 is supplied with water, and rotary drum 5 is rotated to rinse clothes 4 therein. In the dewatering cycle, drain valve 10 is opened to permit water to drain outside the machine and rotary drum 5 holding clothes 4 is then rotated at a high speed to extract water therefrom.

During the washing operation, water tub 3 vibrates due to rotational vibration of rotary drum 5. Suspensions 2 absorb the vibration of water tub 3 to thereby suppress the vibration of housing 1, and the heat pump is mounted on base 35. Therefore, the heat pump is rarely affected by the vibration of water tub 3 propagated through housing 1. Further, since air exhaust hose 36 which connects the inlet of heat absorber duct 21 to air exhaust duct outlet 23 and air supply hose 37 which connects the outlet of heat radiator duct 33 to air supply duct inlet 21 are made of flexible cylindrical members, the vibration of water tub 3 is not transmitted directly to the heat pump. Therefore, structural weakening of connections formed in the heat pump and fatigue failure of pipework 43 are effectively prevented. Further, air exhaust hose 36 and air supply hose 37 can be made of flexible cylindrical members of same shape and material as experiencing nearly identical vibration for being disposed under water tub 3 and extending therefrom parallel with each other.

In a drying operation, compressor 41 operates to make the coolant become high-pressure coolant and circulate through heat radiator 32, throttle valve 42 and heat absorber 30. Heat radiator 32 allows the high-pressure coolant to dissipate heat, and heat absorber 30 permits the low-pressure coolant depressurized by throttle valve 42 to absorb heat from surroundings. At this time, blower 12 is operated to force the drying air heated by heat radiator 32 to flow through air supply duct 20 and air injection opening 14 into rotary drum 5. Rotary drum is rotated by driving motor 6, so that clothes 4 are moved up and down to tumble.

While passing through clothes 4 tumbling in rotary drum 5, the heated air extracts moisture from clothes 4 to become moist air. Then, the moist air passes through air outlet 16 of water tub 3, air exhaust duct 22, air exhaust hose 36 and cleaner 38 into heat absorber conduct 31. When the moist air passes through cleaner 38, particulates such as lint in the moist air are removed. While passing through heat absorber 30, the moist air loses sensible heat and latent heat to be condensed, so that the moist air is divided into dry air and condensation. The dry air passes through connection duct 34 into heat radiator duct 34 in which the dry air is heated by heat radiator 32. The heated air, then, flows through air supply hose 37 and air supply duct 20 into blower 12.

The condensation formed by heat absorber 30 is drained to the outside of the machine through water exhaust opening 39. Since such a heat pump as described above allows the heat collected by the coolant in heat absorber 30 to be reused in heat radiator 32 to heat the dry air, heat collected in heat absorber 30 as well as heat generated by energy input to compressor 41 is supplied to clothes 4, so that reduction in drying time and saving on energy can be achieved.

As described above, the heat pump is disposed under water tub 3 and connected to water tub 3 at a lower portion thereof through air supply hose 37 and air exhaust hose 36 made of flexible cylindrical members, and therefore, door opening 1*a* can be located at a higher position to facilitate loading and unloading of clothes 14. Further, lengths of air exhaust hose 36 and air supply hose 37 can be shorter to make the machine compact. In addition, since the heat pump, air exhaust hose 36 and air supply hose 37 are rarely affected by the vibration of water tub 3, reliability and durability of the machine are improved.

Further, although air exhaust hose 36 and air supply hose 37 are disposed under water tub 3 and at left and right portion thereof in this preferred embodiment, they may be arranged at front and rear portion of water tub 3 according to a certain layout of the heat pump.

Embodiment 2

FIGS. 5 to 8 depict a washing and drying machine in accordance with a second embodiment, wherein like parts to those of the first embodiment are represented by like reference numerals and detailed descriptions thereof will be omitted for simplicity.

In housing 1, the machine includes cylindrical water tub 3, which is elastically supported by a plural number of suspensions 2; cylindrical rotary drum 5 for holding clothes 4, which is mounted rotatably in water tub 3; driving motor 6 for rotating rotary drum 5; and heat pump, which is provided with a throttle valve (not shown), heat absorber 30, heat radiator 32, compressor 41 and pipework 43 for allowing the coolant to circulate through the throttle valve, heat absorber 30, heat radiator 32, and compressor 41. An axis of rotary drum 5 slants at about 5 to 45° such that mouth 5*a* of rotary drum 5 is raised, and water tub 3 also slants in a similar manner. Clothes 4 are loaded into and unloaded from rotary drum 5 through door opening 1*a* formed in a front wall of housing 1 and mouth 3*a* of water tub 3 and mouth 5*a* of rotary drum 5. Door 7 for closing and opening door opening la is disposed adjacent door opening 1*a*. Further, bellows 8 connecting mouth 3*a* of water tub 3 to opening 1*a* of housing 1 provides water seal. Formed in lower portion of water tub 3 is drain 9 for allowing water in water tub 3 to be drained, to which drain valve 10 is connected.

The heat pump is disposed at a lower part of space between rear wall 1*b* of housing 1 and water tub 3 slanting with its mouth 3*a* raised. Heat absorber 30 and heat radiator 32 are arranged side by side parallel with rear wall 1*b* of housing 1. Compressor 41 is disposed under water tub 3 and adjacent to a sidewall of housing 1. Disposed between heat absorber 30 and heat radiator 32, i.e., in connection duct 34 is blower 12, blowing means, for forcing air heated by heat radiator 32 to flow into rotary drum 5.

An inlet of heat absorber duct 31 and air exhaust duct outlet 23 communicate with each other through air exhaust hose 36 formed with flexible bellows hose made of flexible material. Similarly, an outlet of heat radiator duct 33 and air supply duct inlet 21 communicate with each other through air supply hose 37 formed with flexible bellows hose made of flexible material. As shown in FIGS. 5 to 8, the heat pump is disposed between a rear portion of water tub 3 and rear wall 1*b*, and air exhaust hose 36 and air supply hose 37 are disposed on the rear portion of water tub 3 in the same direction. Therefore, lengths of air exhaust hose 36 and air supply hose 37 can be shorter, so that the machine becomes more compact.

Further, connections of air exhaust hose 36 and air supply hose 37 are carried out by means of fixtures such as hose clips (not shown), which facilitate coupling and decoupling thereof. Moreover, the heat pump including compressor 41, heat radiator 32, heat absorber 30, pipework 43, heat absorber duct 31, heat radiator duct 33 and connection duct 34, and blower 12 are mounted on base 35 which is detachable or drawable from housing 1.

In the machine described above, analogous to the first embodiment 1, vibration of water tub 3 due to rotational vibration of rotary drum 5 is not transmitted directly to the heat pump because air exhaust hose 36 and air supply hose 37 are flexible, i.e., expanded, contracted and bent without resisting against the vibration of water tub 3. Therefore, structural weakening of connections in the heat pump and fatigue failure of pipework 43 are prevented. Further, since air exhaust hose 36 and air supply hose 37 extend from the rear portion of water tub 3 parallel with each other, they do not interfere with each other under the vibration. Moreover, since hoses 36 and 37 experience substantially identical vibrations, they can be made of a hose having same shape and material.

Figure 7:
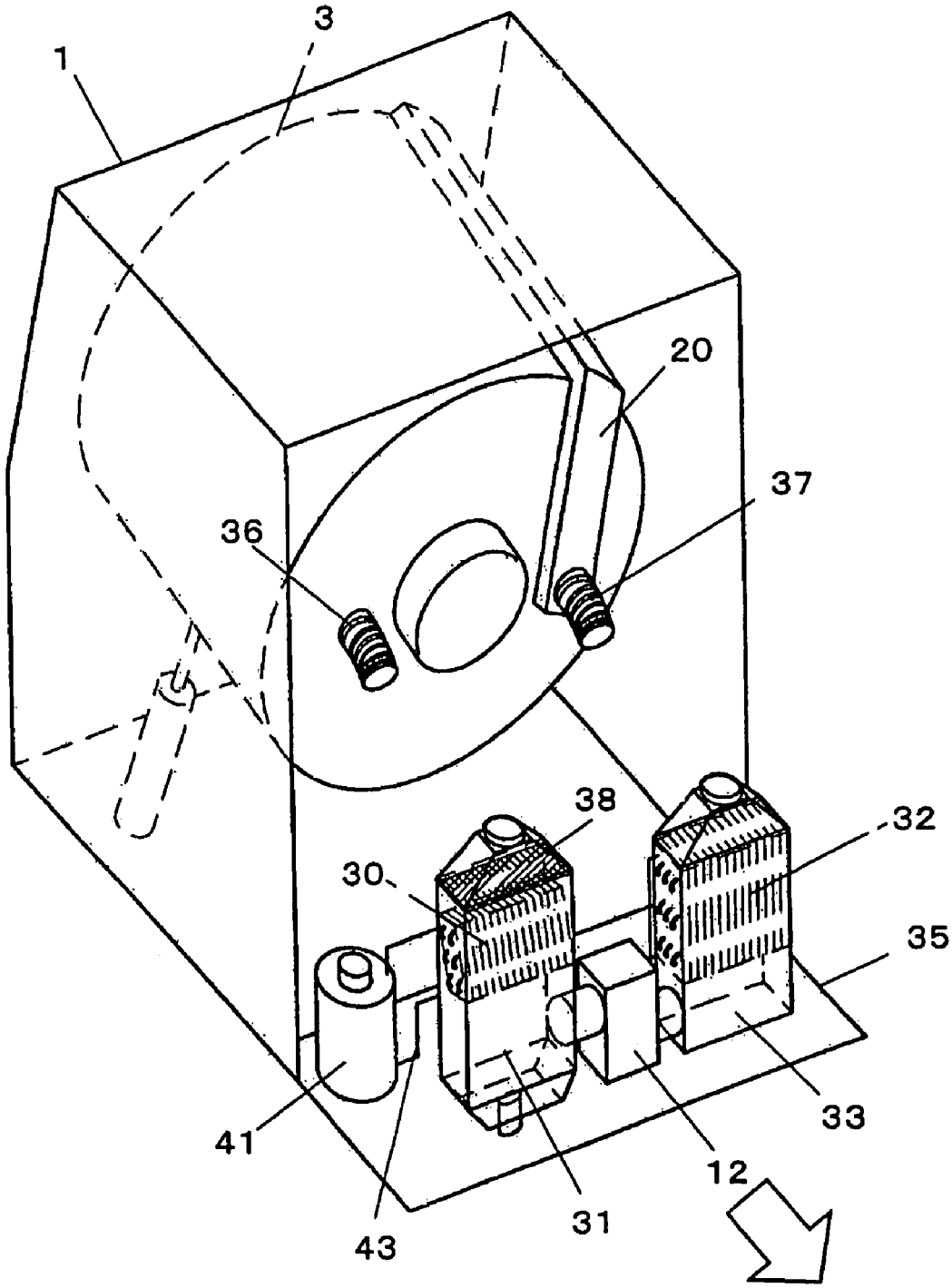
FIG. 7 exhibits a perspective view of the machine in accordance with the second embodiment with a heat pump withdrawn.

Further, in this embodiment, base 35 can be drawn from housing 1 backwards as shown in FIG. 7. In addition, the heat pump can be separated from water tub 3 by decoupling hoses 36 and 37 as shown in FIG. 7. Therefore, repair and maintenance of the heat pump are readily performed, and assembling process for manufacturing the machine is also readily performed.

Particularly, since surface of cleaner 38 can be observed by decoupling hoses 36 and 37 from the heat pump as shown in FIG. 7 during repair or maintenance of the heat pump, degree of clogging of cleaner 38 can be readily inspected.

Further, alternatively, by decoupling hoses 36 and 37 from water tub 3, air pathway or air supply duct 20 in water tub 3 can be inspected. Therefore, removing lint, which may be generated from clothes, can be easily done.

Figure 8A:
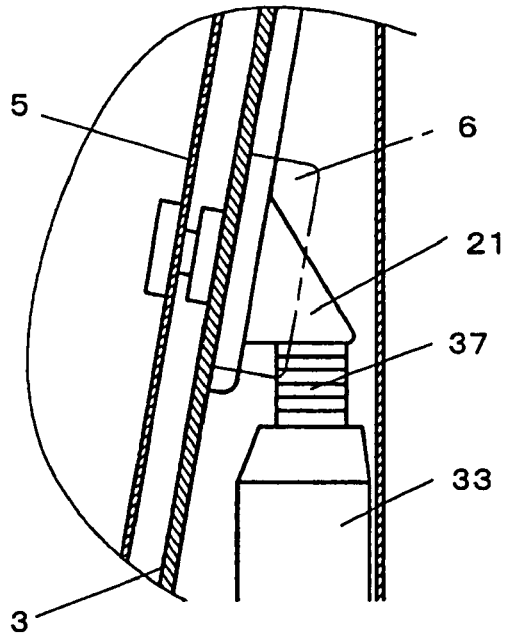
FIGS. 8A and 8B illustrate air supply hoses connecting an air supply duct inlet to a heat radiator duct with different arrangements.
Figure 8B:
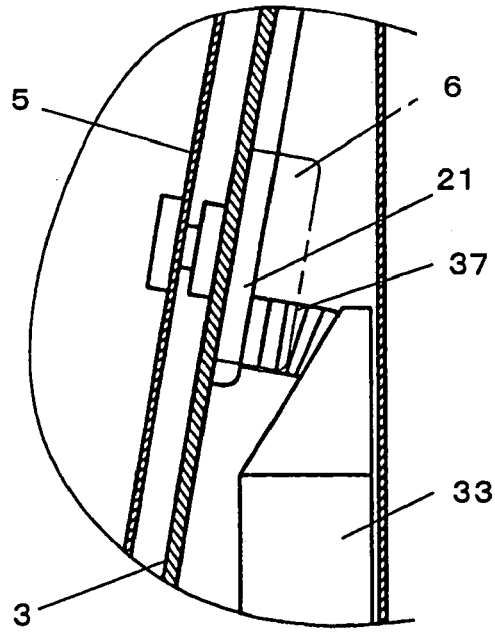

Further, in the machine as described above, although the connection between an inlet of heat absorber duct 31 and air exhaust duct outlet 23 and the connection between an outlet of heat radiator duct 33 and air supply duct inlet 21 are made by hoses 36 and 37 formed with flexible bellows hoses which are bent at about 90° and made of flexible cylindrical member, the present invention is not limited thereto. For example, as shown in FIG. 8*a*, air supply hose 37 may extend straight downwards nearly along the rear portion of water tub 3 to be connected to the inlet of heat radiator duct 33. Therefore, the length of air supply hose 37 becomes shorter, and torsion exerted thereon is also reduced. Further, as shown in FIG. 8*b*, air supply hose 37 may extend straight from the rear portion of water tub 3 in an approximately horizontal direction and the outlet of heat radiator duct 33 may be arranged to face the rear portion of water tub 3, so that air supply hose 37 is connected to the outlet of heat radiator duct 33 in a straight line. In this case, the length of air supply hose 37 becomes shorter, and torsion exerted thereon is also reduced.

Embodiment 3

Figure 9:
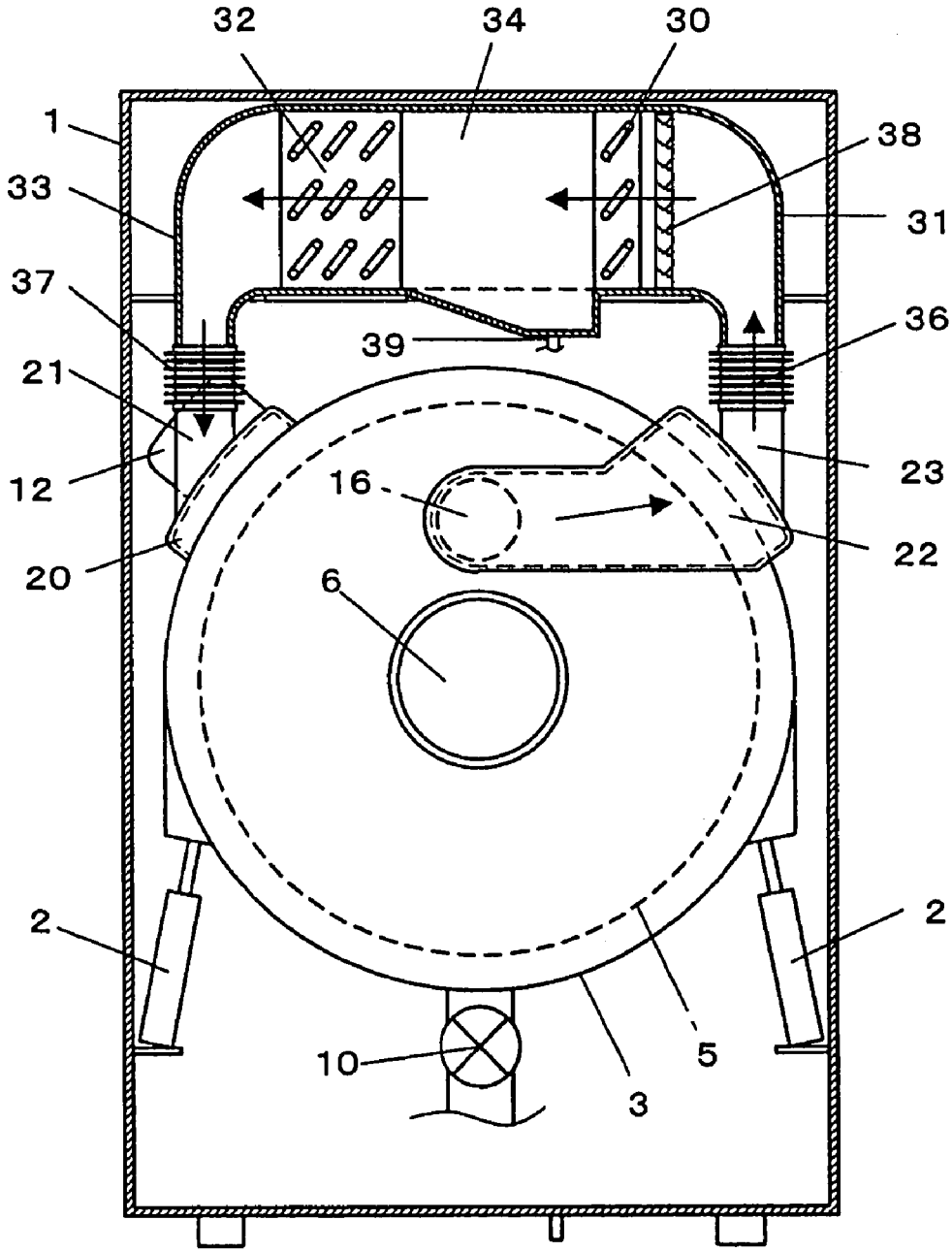
FIG. 9 describes a cross sectional view of a washing and drying machine in accordance with a third embodiment of the present invention.

FIG. 9 presents a cross sectional view of a washing and drying machine in accordance with a third embodiment of the present invention taken from rear wall 1*b*, wherein like parts to those of the first embodiment are represented by like numerals and detailed descriptions thereof will be omitted for simplicity.

In this embodiment, the heat pump is disposed above water tub 3. As shown in FIG. 9, heat absorber 30, heat absorber duct 31, heat radiator 32, heat radiator duct 33, connection duct 34, compressor 41 (not shown), throttle valve 42 (not shown) and pipework 43 (not shown), all of which are components of the heat pump, are disposed above water tub 3.

An inlet of heat absorber duct 31 is connected to air exhaust duct outlet 23 through air exhaust hose 36 made of bellows-shaped flexible material. An outlet of heat radiator duct 33 is also connected to air supply duct inlet 21 through air supply hose 37 made of bellows-shaped flexible material. Further, removably installed at upstream of heat absorber duct 31 is air cleaner 38 for removing foreign matter in the drying air. Moreover, formed at a lower portion of heat absorber duct 31 in downstream thereof is water exhaust opening 39 for draining condensation.

The heat pump is mounted above water tub 3, so that washing water is not introduced through drying air pathway into heat absorber 30 and heat radiator 32. Generally, heat absorber 30 and heat radiator 32 are made of very thermally conductive metals such as copper, aluminum and the like, which may be corroded by detergent, fabric softener, bleach and the like. Therefore, by preventing washing water from making incursion to heat absorber 30 and heat radiator 32, reliability and durability of the machine can be improved.

As described above, since the heat pump is disposed above water tub 3, air exhaust hose 36 and air supply hose 37 are also disposed above water tub 3, lengths of hoses 36 and 37 become shorter to make the machine compact.

Further, other parts of the heat pump, i.e., compressor 41 and throttle valve 42, which have no connection with incursion of washing water into heat absorber 30 and heat radiator 32, are not necessarily disposed above water tub 3.

Embodiment 4

Figure 10:
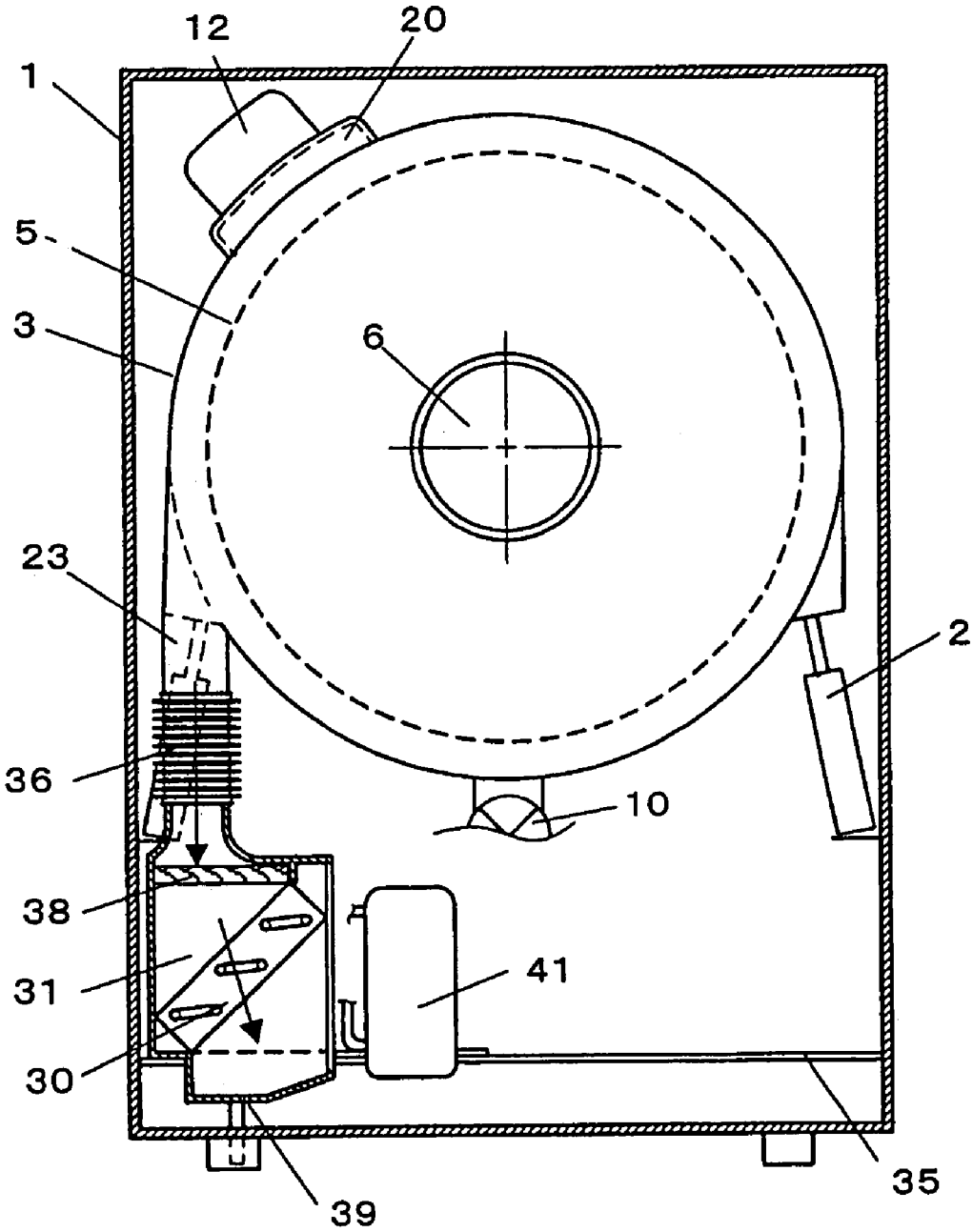
FIG. 10 explains a cross sectional view of a washing and drying machine in accordance with a fourth embodiment of the present invention taken from a rear wall.
Figure 11:
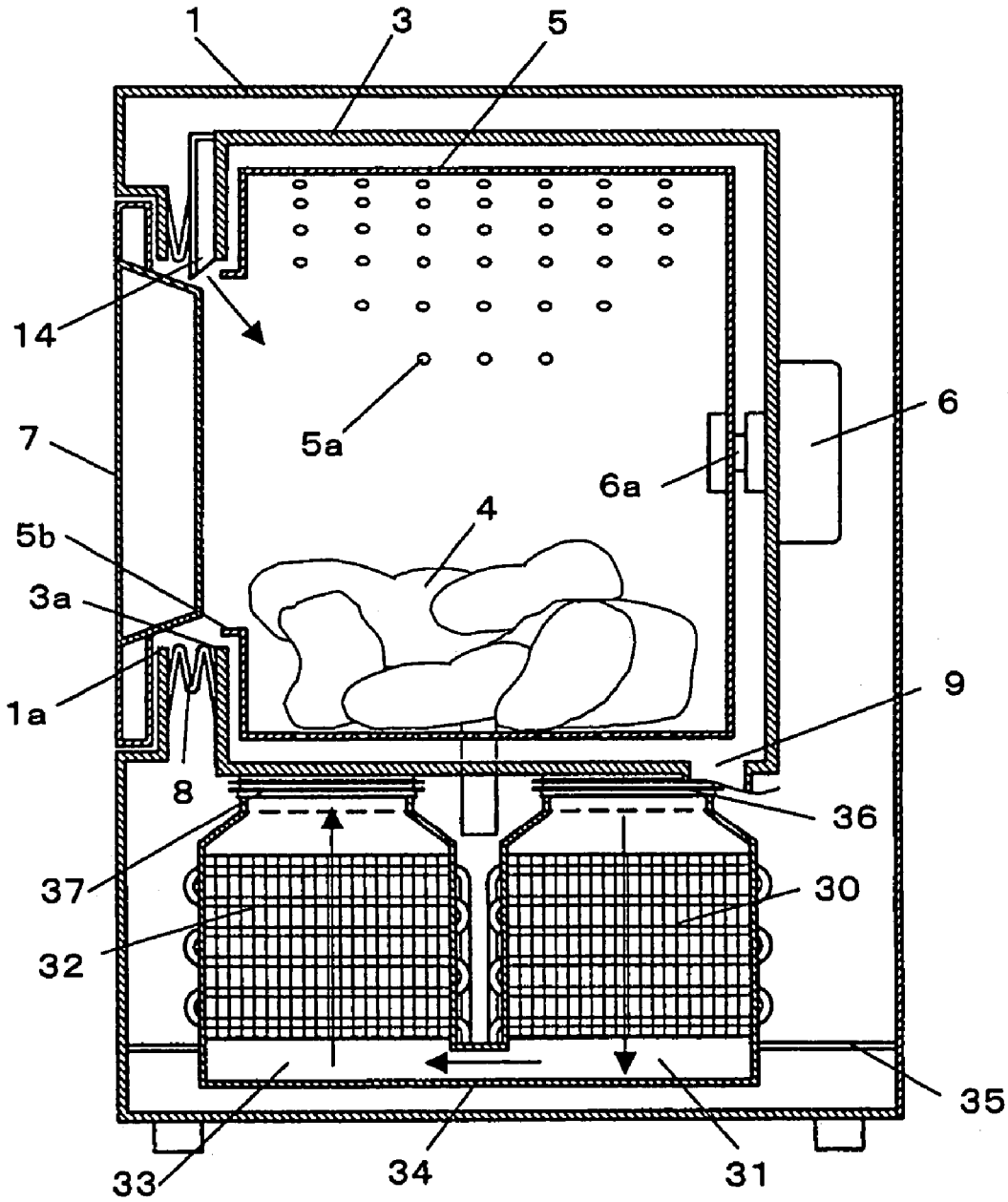
FIG. 11 shows a cross sectional view of the machine in accordance with the fourth embodiment.

A fourth embodiment in accordance with the invention will now be described with reference to FIGS. 10 and 11. FIG. 10 shows a cross sectional view of a washing and drying machine in accordance with the fourth embodiment taken from a rear wall. FIG. 11 depicts a cross sectional view taken from a sidewall of housing 1. Parts like to those of the first embodiment are represented like numerals, and detailed descriptions thereof will be omitted for simplicity.

As shown in FIGS. 10 and 11, disposed beside a sidewall of housing 1 is a heat pump provided with heat absorber 30, heat absorber duct 31, heat radiator 32, heat radiator duct 33, connection duct 34, compressor 41, throttle valve 42 (not shown in FIGS. 10 and 11) and pipework 43 (not shown in FIGS. 10 and 11). By mounting a door (not shown) for repair and maintenance on housing 1 beside the heat pump, inspection of the heat pump and replacement of components thereof are facilitated to make maintenance of the machine easy. Further, inspection of air cleaner 38 for checking degree of clogging is facilitated by separating air exhaust hose 36 from the heat pump.

Further, as shown in FIGS. 10 and 11, air exhaust hose 36 and air supply hose 37 extend downwards from water tub 3 to the heat pump, while being parallel with each other and disposed beside water tub 3. Therefore, lengths of hoses 36 and 37 become shorter, so that the machine becomes more compact. In addition, since the heat pump and hoses 36 and 37 are rarely affected by vibration of water tub 3, reliability and durability of the machine are improved.

Embodiment 5

Figure 12:
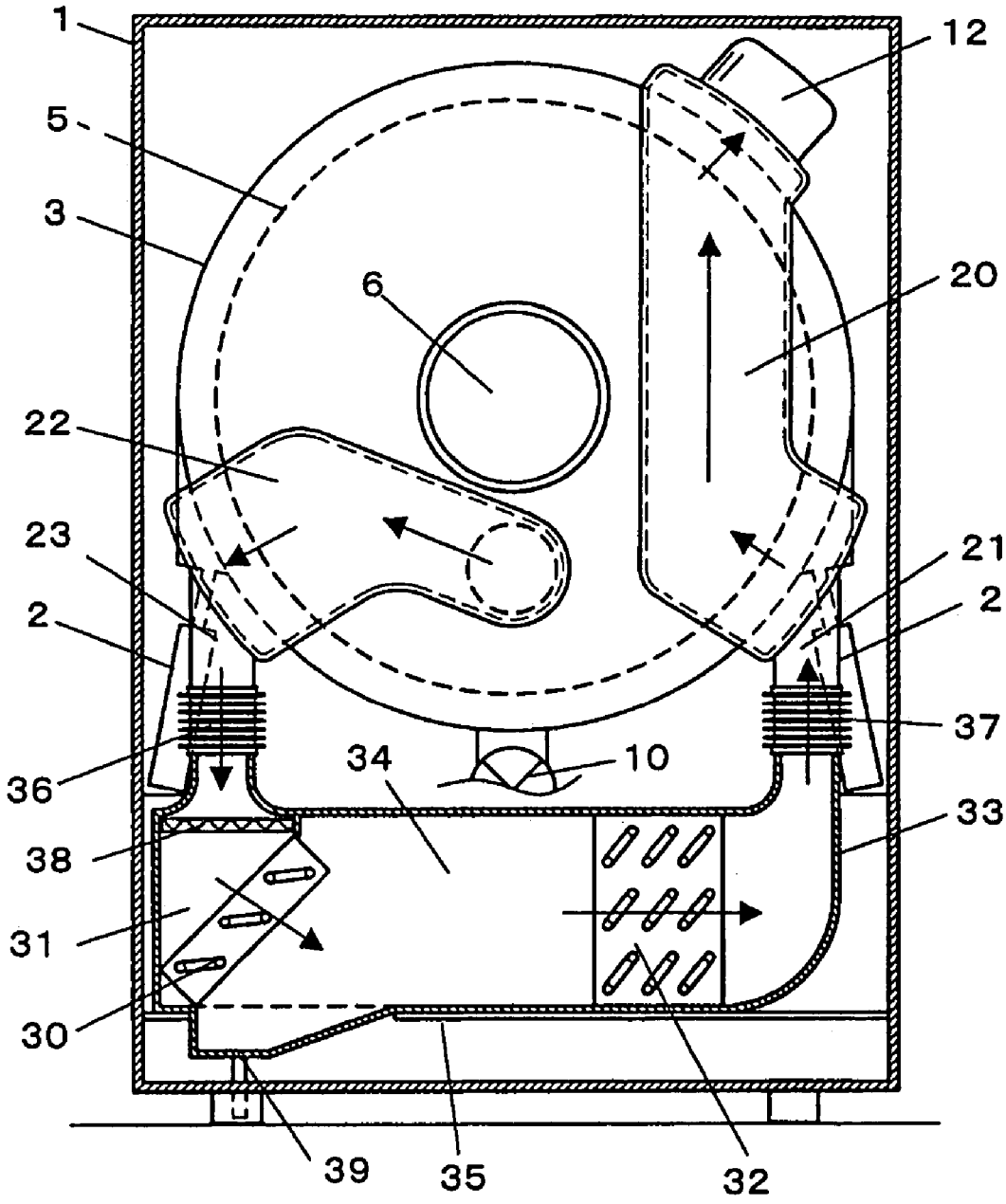
FIG. 12 provides a cross sectional view of a washing and drying machine in accordance with a fifth embodiment of the present invention.

A washing and drying machine in accordance with a fifth embodiment of the invention will now be described with reference to FIG. 12. FIG. 12 presents a cross sectional view of this embodiment taken from a rear wall. This embodiment is structurally different from the first embodiment in the following arrangements.

As shown in FIG. 12, heat absorber 30 disposed in heat absorber duct 31 slants in a manner that a side of heat absorber 31 facing incoming airflow is an upper surface. Further, disposed under a lower surface of heat absorber 31 is water exhaust opening 39 for draining condensation.

With such arrangements, condensation formed by heat absorber 30 is effectively collected in a recessed portion of heat absorber duct 31 as air flows through heat absorber 30, and the collected condensation is also effectively drained from the recessed portion through water exhaust opening 39 by the airflow.

Embodiment 6

Figure 13:
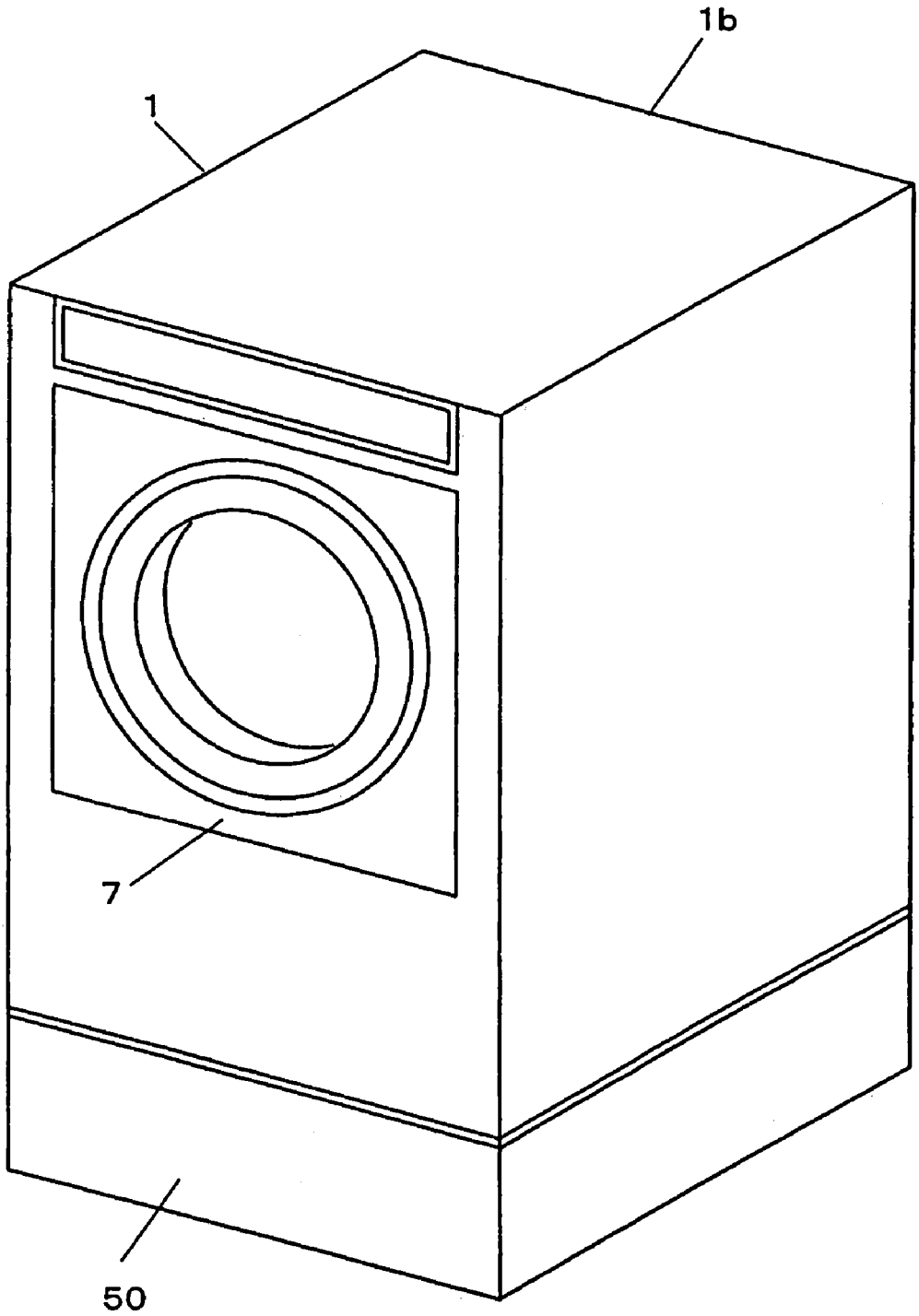
FIG. 13 displays a perspective view of a washing and drying machine of a sixth embodiment of the present invention, showing its external appearance.
Figure 14:
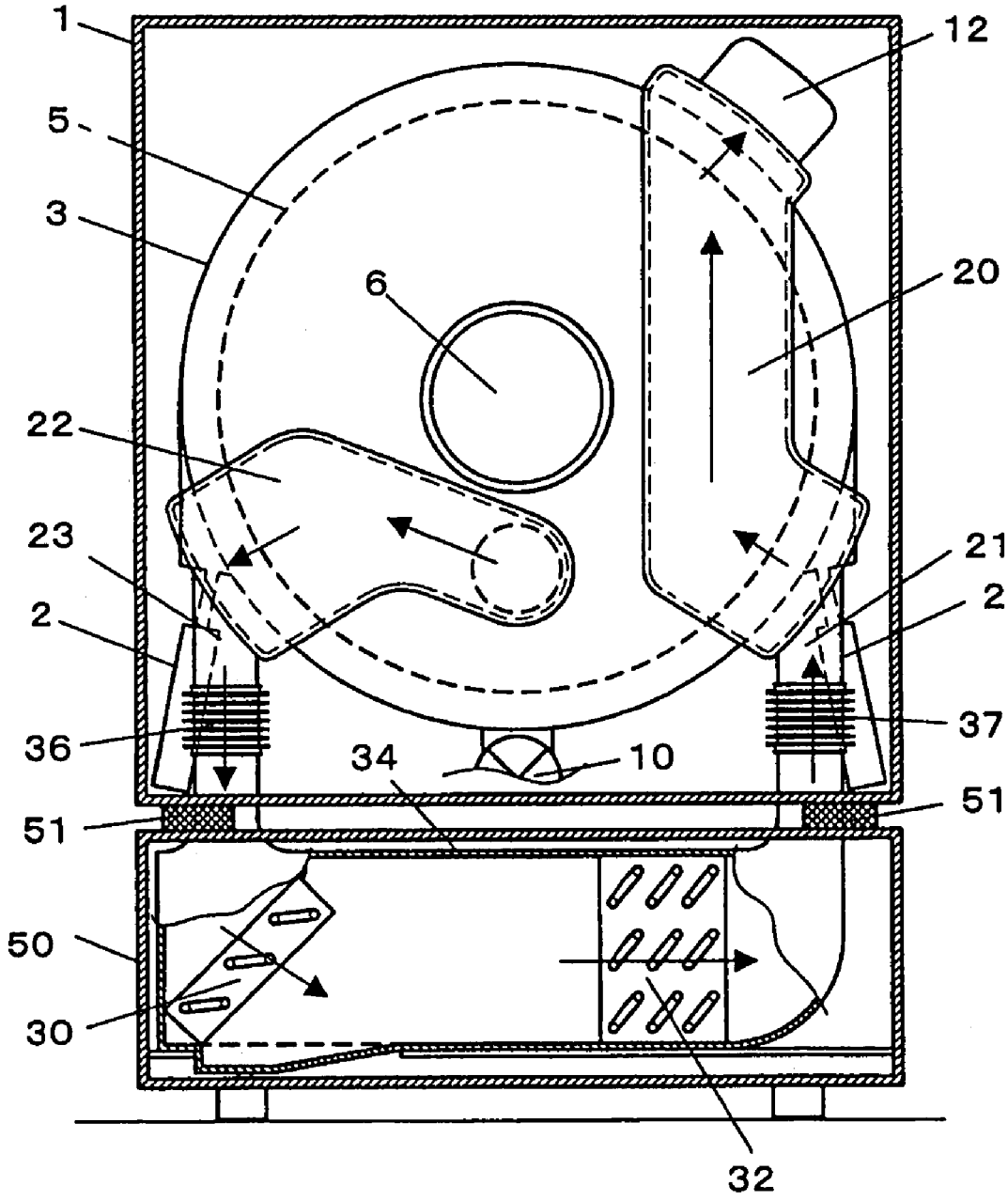
FIG. 14 is a cross sectional view taken from a rear wall.

A sixth embodiment of a washing and drying machine in accordance with the invention will now be described with reference to FIGS. 13 and 14. FIG. 13 sets forth a perspective view of the washing and drying machine of this embodiment showing its exterior appearance. FIG. 14 illustrates a cross sectional view taken from rear wall 1*b*. This embodiment is different from the fifth embodiment in several points as is described below.

As shown in FIGS. 13 and 14, washing and drying machine in accordance with this embodiment includes mounting stand 50 for mounting thereon housing 1 at a certain height. Further, as shown in FIG. 14, disposed at four points of a bottom wall of housing 1 are four legs 51 made of an elastic material with a high vibration absorbing characteristics. Disposed within mounting stand 50 is the heat pump which is provided with heat absorber 30, heat absorber duct 31, heat radiator 32, heat radiator duct 33, compressor 41 (not shown in FIGS. 13 and 14), throttle valve 42 (not shown in FIGS. 13 and 14) and pipework 43 (not shown in FIGS. 13 and 14).

According to the aforementioned arrangements, since the heat pump is disposed within mounting stand 50, the assembling process and maintenance of heat pump can be performed independently of those of housing 1. Further, legs 51 attached between mounting stand 50 and housing 1 suppress propagation of vibration from housing 1 to mounting stand 50, and thus, the heat pump is rarely affected by vibration of water tub 3 during the washing and dewatering cycles.

As described above, by separating the heat pump from housing 1, influence of vibration of housing 1 on the heat pump is reduced, and assembling process, maintenance and repair are facilitated.

Embodiment 7

Figure 15:
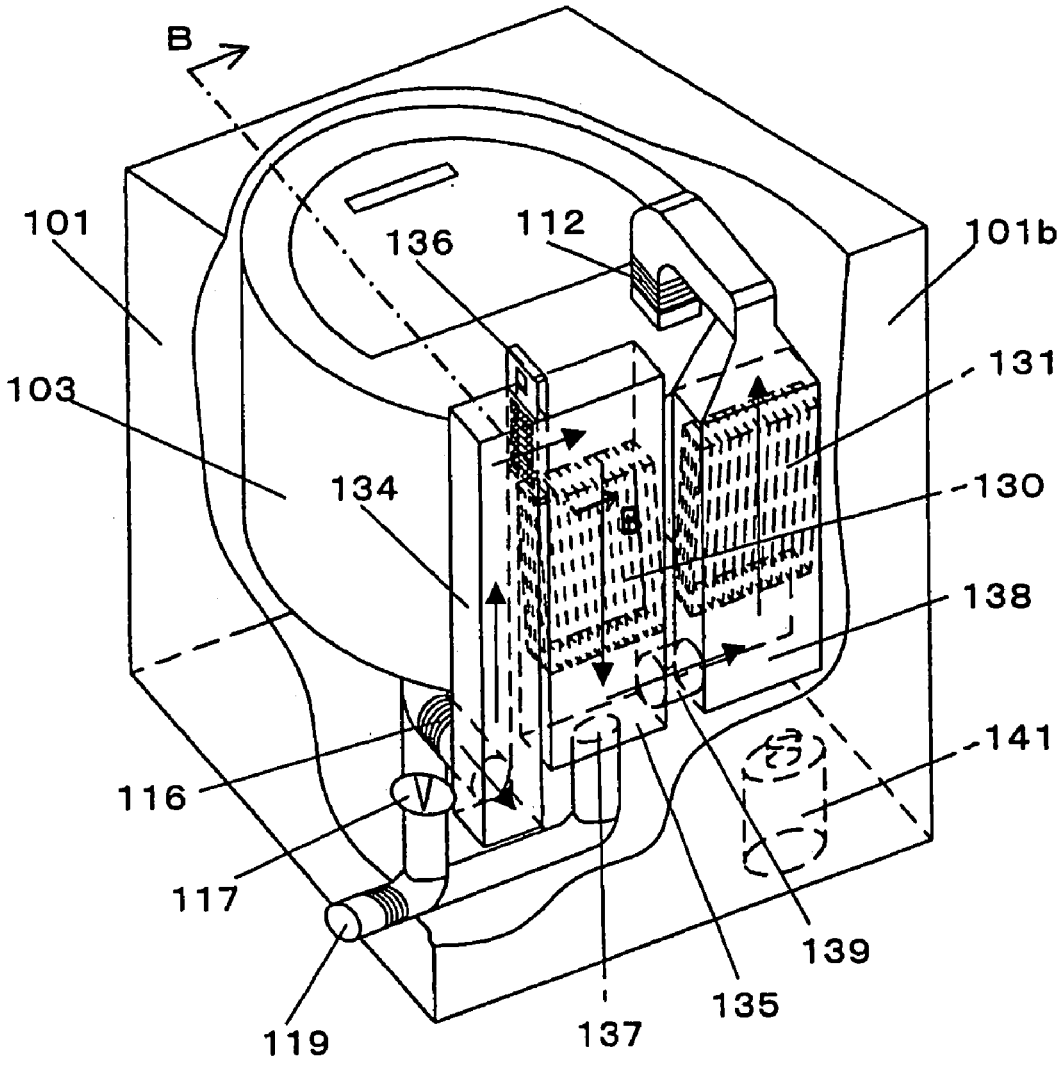
FIG. 15 illustrates a perspective view of a washing and drying machine in accordance with a seventh embodiment of the present invention with a portion thereof cutaway.
Figure 16:
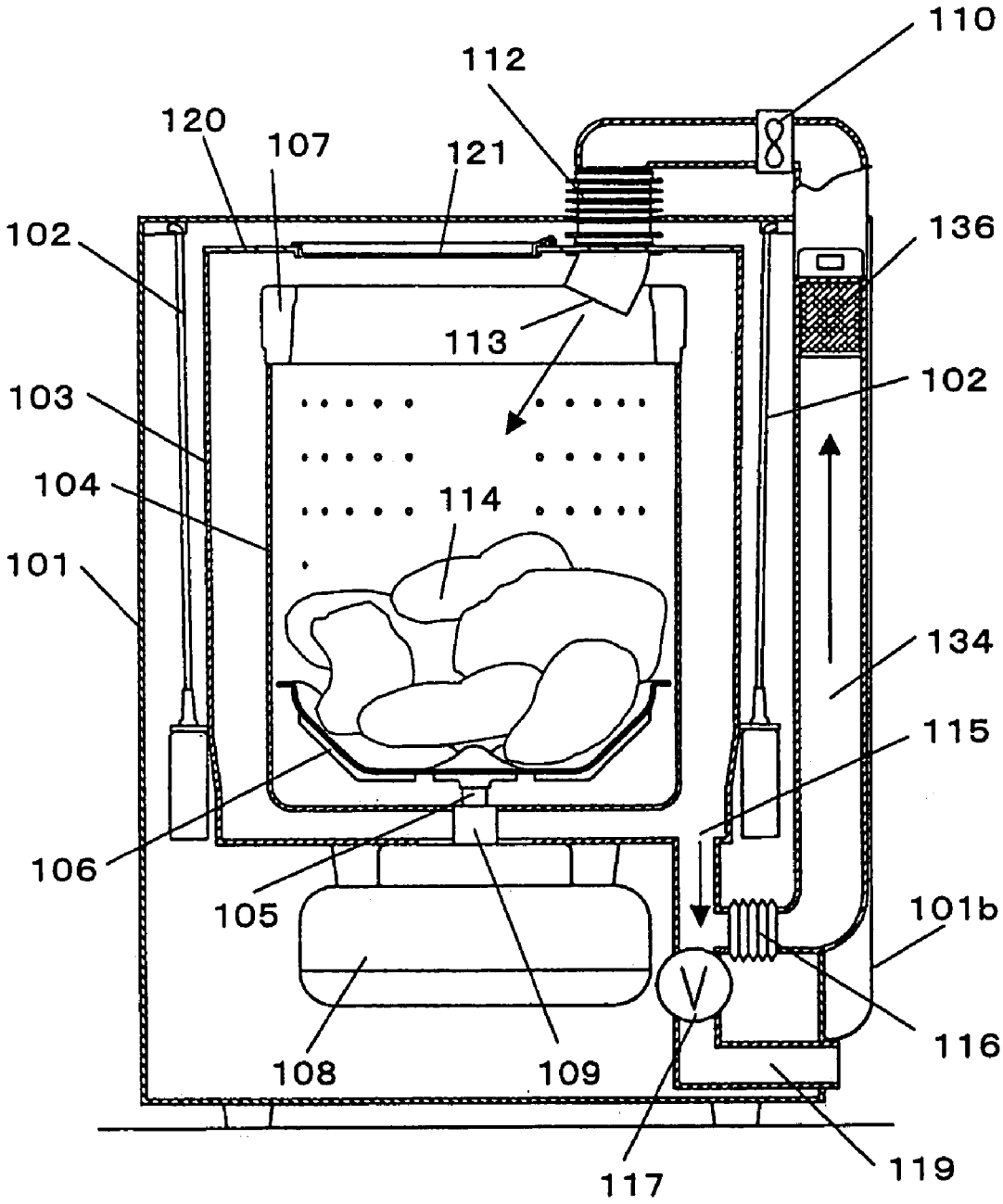
FIG. 16 depicts a cross sectional view of the machine taken along line B-B of FIG. 15.

A washing and drying machine in accordance with a seventh embodiment of the present invention will now be described with reference to FIGS. 15 and 16. FIG. 15 offers a perspective view of the washing and drying machine of this embodiment with a portion thereof cutaway. FIG. 16 illustrates a cross sectional view of the washing and drying machine of this embodiment taken along line B-B of FIG. 15.

As shown in FIGS. 15 and 16, mounted in housing 101 is cylindrical water tub 103 which is elastically suspended on a plural number of suspensions 102 absorbing vibration of water tub 103. In water tub 103, cylindrical rotary drum 104 for holding laundry articles 114 to be washed or dried (referred to as clothes hereinafter) is mounted rotatably, which is rotated around axle 105. Agitator 106 is rotatably mounted to an inner bottom portion of rotary drum 104. Further, liquid balancer 107 is attached around a mouth of rotary drum 104, liquid balancer 107 is attached.

Mounted below a bottom of water tub 103 is drive device 108 including a driving motor, which rotates axle 105 through clutch 109. Agitator 106 has a shape of bowl having a peripheral portion curved upward, and rotatory force of agitator 106 makes clothes 114 move upward during a drying operation. Disposed between water tub 103 and rear wall 101*b* of housing 101 is a heat pump provided with heat absorber 130 and heat radiator 131, heat exchangers.

Blower 110, a blowing device, causes drying air to flow through air supply hose 112 and air injection opening 113 into rotary drum 104. The drying air supplied into rotary drum 104 passes through clothes 114 and flows to outside of water tub 103 through air outlet 115 formed on a bottom portion of water tub 103. The air outlet 115 is connected to air exhaust hose 116 made of bellows hose, and communicates with heat absorber duct 135 through air exhaust hose 116 and air exhaust duct 134. Heat absorber duct 135 allows the drying air to flow from an upper portion of heat absorber 130 to a lower portion thereof. Air exhaust duct 134 is constructed such that the drying air flows from its lower portion to its upper portion. Air exhaust duct 134 is connected to heat absorber duct 135 at a position higher than a water level of water supplied into water tub 103. Removably disposed in connection portion between air exhaust duct 134 and heat absorber duct 135 is air cleaner 136 for filtering off foreign matter in the drying air, which is made of, e.g., synthetic fiber net.

Heat absorber 130 in heat absorber duct 135 slants in a manner that an upper portion of heat absorber 130, i.e., a portion of heat absorber 130 disposed in an upstream of the drying air flowing through heat absorber duct 135, is closer to water tub 103 than a lower portion thereof. With such arrangements, loss in pressure of drying air is reduced and, in a case where foreign matter, which are not filtered by air cleaner 136, are introduced into heat absorber 130, the foreign matter come to adhere to a surface thereof facing rear wall 101*b* and thus, cleaning of heat absorber 130 can readily be performed. Formed on a bottom portion of heat absorber duct 135 is water exhaust opening 137 for draining condensation.

The drying air flowing downwards through heat absorber duct 135 passes through connection duct 139 into heat radiator duct 138 for allowing the drying air to flow upwards through heat radiator 131. An outlet of heat radiator duct 138 is connected to blower 110, which forces the drying air flowing upwards through heat radiator 131 to be supplied into rotary drum 104 through air injection opening 113.

Heat radiator 131 in heat radiator duct 138 slants in a manner that a lower portion of heat radiator 131, i.e., a portion thereof disposed in an upstream of the drying air passing through heat radiator 131, is closer to water tub 103 than an upper portion thereof is. With such arrangements, loss in pressure of drying air is reduced and, in a case where foreign matter are introduced into heat radiator 131, cleaning of heat absorber 130 can readily be performed as the foreign matter come to adhere to a surface of heat radiator 131 facing rear wall 101*b*.

The operation of the machine configured as mentioned above will now be described. First, in a washing cycle, water is supplied into water tub 103 to a predetermined water level with drain valve 117 closed. Then, water tub 103 containing washing water and clothes 114 is rotated by drive device 108. The washing water between water tub 103 and rotary drum 104 is moved upwards along a cylindrical wall of water tub 103 because of centrifugal force generated by rotation of rotary drum 104, and then introduced into rotary drum 104 from an upper portion thereof. Therefore, the washing water circulates while passing through clothes 114.

Although the washing water is introduced into air exhaust duct 134 at this time, it is not introduced into heat absorber duct 135 since air exhaust duct 134 is connected to heat absorber duct 135 at a position higher than an upper portion of water tub 103, i.e., a position higher than a water level of the washing water in water tub 103. Consequently, corrosion of heat absorber 130 caused by incursion of washing water does not take place, and heat absorber 130 is not clogged with lint in washing water. Further, in a rinsing cycle following the washing cycle, similarly, water is supplied to water tub 103 and rotary drum 104 is rotated to rinse clothes 114 without making any incursion of water into heat absorber 130. In a dewatering cycle, water in water tub 103 is drained through drain hose 119 to outside of the machine, and rotary drum 104 holding clothes 114 is then rotated at a high speed by drive device 108.

In a drying operation, when compressor 141 is energized, coolant is compressed and forced to flow through heat radiator 131, a throttle valve (not shown) for lowering pressure of the high-pressure coolant and heat absorber 130. Heat radiator 131 allows the high-pressure coolant to dissipate heat, and heat absorber. 130 allows the low-pressure coolant to absorb heat. At this time, air heated by heat radiator 131 is forced to flow through air supply hose 112 to air injection opening 113 into rotary drum 104, and agitator 106 is rotated by drive device 108, so that clothes 114 are agitated.

The heated air supplied into rotary drum 104 passes through clothes 114 and extracts moisture therefrom to become moist air. The moist air passes through air outlet 115 formed in a bottom portion of water tub 103, air exhaust hose 116 and air exhaust duct 134. Then, the moist air flows into heat absorber duct 135 through air cleaner 136 which removes foreign matter such as lint therefrom. When passing through heat absorber 130, the moist air loses sensible heat and latent heat thereto to be divided into dry air and condensation. The dry air flows into heat radiator duct 138 through connection duct 139, and then, is heated again by heat radiator 131 to become the heated air that returns to blower 110.

Further, condensation formed by heat absorber 130 is forcibly moved downwards by airflow in heat absorber duct 135, and then drained to outside of the machine through water exhaust opening 137 and drain hose 119. By using such a heat pump as described above, heat absorbed by heat absorber 130 is transferred to heat radiator 131 by the coolant and dissipated therefrom. Therefore, since heat absorbed by heat absorber 130 as well as heat generated by energy input to compressor 141 is used to dry clothes 114, reduction in drying time and saving on energy are achieved.

In the washing and drying machine configured as described above, vibration of water tub 103 caused by rotation of rotary drum 104 is rarely transmitted to the heat pump since air supply hose 112 and air exhaust hose 116 are flexible, i.e., bent, expanded or contracted nearly without resisting against the vibration of water tub 103. Therefore, structural weakening of connections in the heat pump and fatigue failure of the pipework thereof due to the vibration of water tub 103 do not take place.

Particularly, in such a top loading washing and drying machine having vertically mounted rotary drum 104 as in this preferred embodiment, vibration of water tub 103 is very complicated since it is a combination of horizontal vibration induced by shaking of rotating rotary drum 104 and vertical vibration induced by vertical movement of water and clothes in rotary drum 104. Therefore, by employing flexible hoses 112 and 116 to connect ducts of the heat pump to ducts of water tub 104, significant reduction in vibration of the heat pump is achieved, so that reliability and durability of the machine are improved.

Embodiment 8

Figure 17:
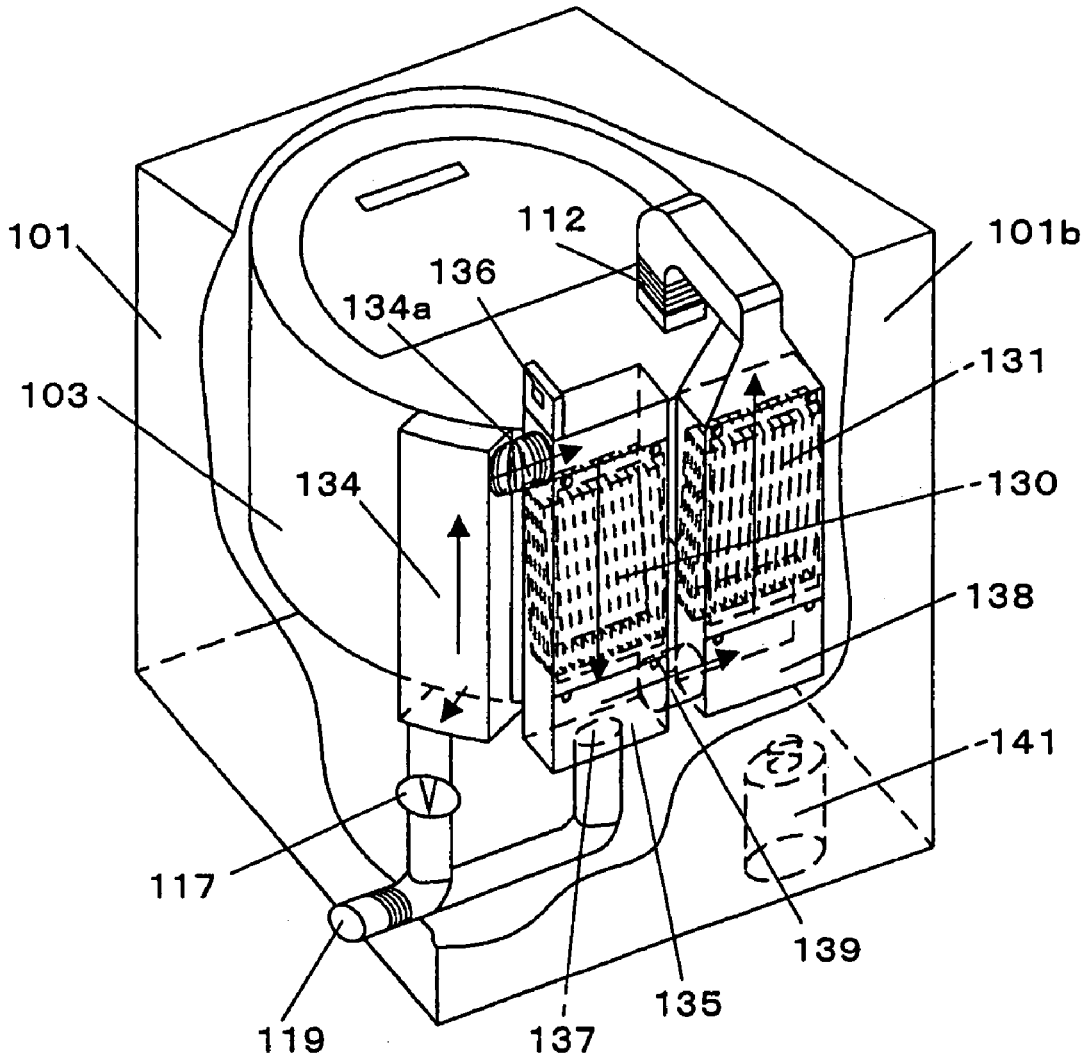
FIG. 17 presents a perspective view of a washing and drying machine in accordance with an eighth embodiment of the present invention that is partially broken away.
Figure 18:
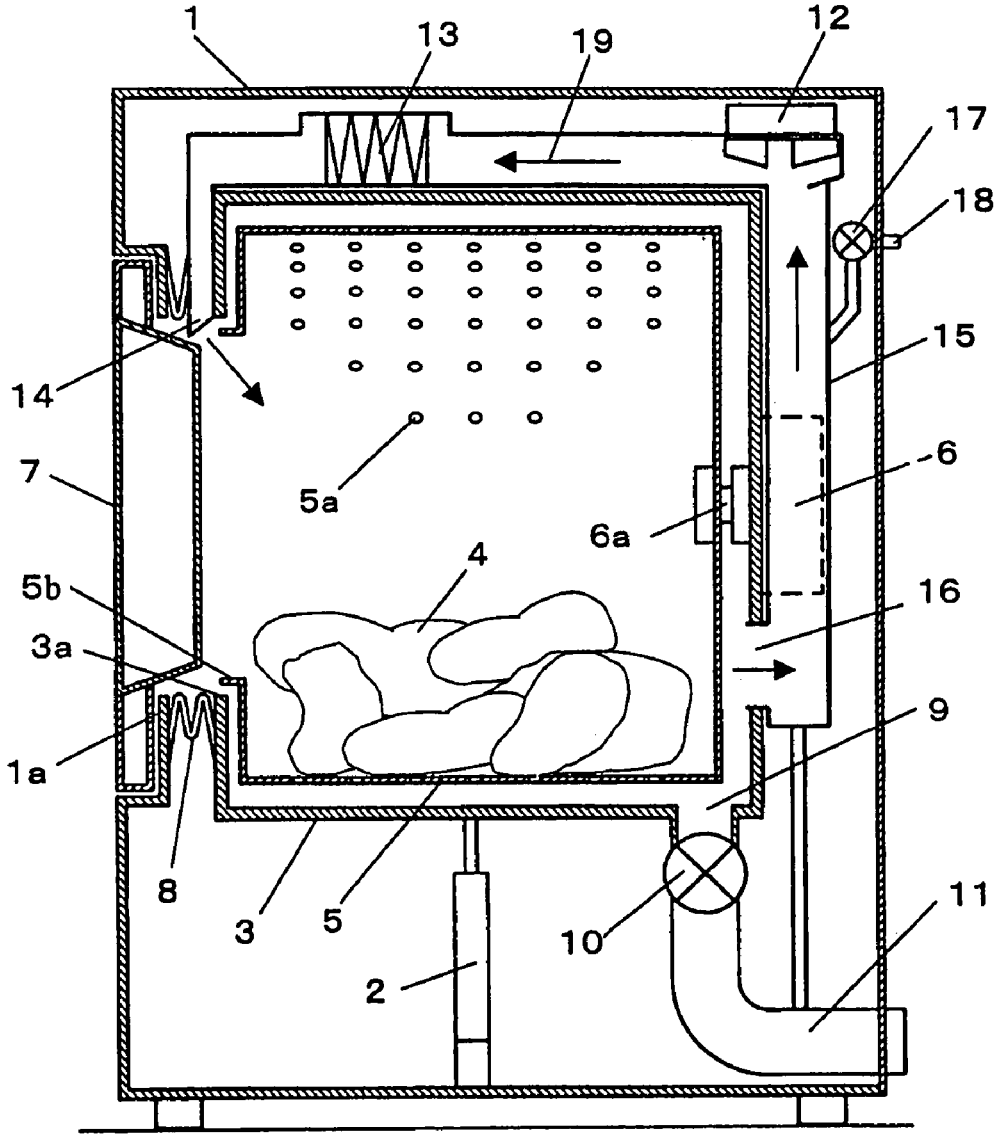
FIG.18 ( PRIOR ART )
FIG. 18 demonstrates a cross sectional view of a conventional washing and drying machine.

FIG. 17 represents a rear perspective view of a washing and drying machine in accordance with an eighth embodiment of the present invention that is partially cut away, wherein like parts to seventh embodiment are represented by like reference numerals, and detailed descriptions thereof will be omitted for simplicity.

As shown in FIG. 17, air exhaust duct 134 is fixed to an outer surface of water tub 103, and integrated therewith. An outlet of air exhaust duct 134 communicates with an inlet of heat absorber duct 135 through air exhaust hose 134*a* made of bellows hose.

In the aforementioned arrangements, the outer surface of water tub 103 serves as one sidewall of air exhaust duct 134. Therefore, reduction in space occupied by air exhaust duct 134 is achieved, and the machine becomes simpler in construction. In addition, since volume of air exhaust duct 134 is reduced, the amount of water filled therein during a washing operation is also reduced.

Further, in this preferred embodiment, it should be noted that heat absorber 130 and heat radiator 131 can be disposed between water tub 103 and a left or right sidewall of housing 101 instead of being disposed between water tub 103 and rear wall 101*b* of housing 101. Further, heat absorber 130 and heat radiator 131 can be accommodated in housing 101 in a space effective manner.

According to the arrangements as described above, even when water tub 103 vibrates due to rotational vibration of rotary drum 104, the vibration of water tub 103 is rarely transmitted to the heat pump as hoses 112 and 134*a* are flexible. Therefore, neither structural weakening of connections in the heat pump nor fatigue failure of pipework of the heat pump takes place.

Particularly, in such a top loading washing and drying machine having a vertically mounted rotary drum 104 as in this preferred embodiment, the vibration of water tub 103 is very complicated since it is a combination of horizontal vibration induced by shaking of rotating rotary drum 104 and vertical vibration induced by vertical movement of water and clothes 114 in rotary drum 104. Therefore, by employing flexible hoses 112 and 135*a* to connect water tub 104 to ducts 137 and 138 of the heat pump, substantial reduction in vibration of the heat pump is realized, so that reliability and durability of the machine are improved.

As described above, the washing and drying machine of the present invention, which is capable of improve reliability and durability by suppressing influence of vibration of a rotary drum on a heat pump, is applicable to any washing machine having a heat pump device for drying clothes, which dehumidifies moist drying air.

While the invention has been shown and described with respect to the preferred embodiments, it will be understood by those skilled in the art that various changes and modifications may be made without departing from the spirit and scope of the invention as defined in the following claims.

What is claimed is:

1. A washing and drying machine, comprising:

a water tub elastically supported in a housing;

a rotary drum for holding clothes, the rotary drum being rotatably mounted in the water tub;

a heat pump including a compressor for compressing coolant, a heat radiator for dissipating heat of the compressed coolant, a throttle valve for lowering a pressure of the coolant, a heat absorber for allowing the coolant to absorb heat from surroundings, a pipework for allowing the coolant to circulate through the compressor, the heat radiator, the throttle valve and the heat absorber, a heat absorber duct for allowing air to flow through the heat absorber, and a heat radiator duct for allowing the air to flow through the heat radiator;

an air passageway provided to the water tub for allowing the air to flow into the rotary drum;

a blower for forcing the air heated by the heat radiator to flow through the air passageway into the rotary drum;

a flexible connection member for connecting the air passageway to the heat radiator duct; and a flexible air exhaust hose for allowing the air to flow out of the water tub, wherein the flexible connection member and the flexible air exhaust hose are disposed on the rear side of the water tub and extend in a same direction.

2. The machine of claim 1, further comprising an air exhaust duct for allowing the air to flow out of the water tub, the air passageway serves as an air supply duct for allowing the air to flow into the rotary drum, the air supply duct being connected to an outlet of the heat radiator duct through the flexible connection member, and the air exhaust duct is connected to an inlet of the heat absorber duct through the flexible air exhaust hose.

3. The machine of claim 1, wherein the flexible connection member is made of a flexible hose.

4. The machine of claim 1, wherein the flexible connection member is connected to an outlet of the heat radiator duct; and the flexible air exhaust hose is connected to an inlet of the heat absorber duct.

5. The machine of claim 1, wherein the flexible connection member is disposed under the water tub.

6. The machine of claim 1, wherein the flexible connection member is disposed above the water tub.

7. The machine of claim 1, wherein the flexible connection member is disposed beside the water tub.

8. The machine of claim 1, wherein the flexible connection member is removably attached between the air passageway and the heat radiator duct.

9. The machine of claim 8, wherein the flexible connection member is removably attached to the heat radiator duct.

10. The machine of claim 8, wherein the flexible connection member is removably attached to the air passageway.

11. The machine of claim 1, wherein the flexible connection member is expanded and contracted in a direction perpendicular to a rotational axis of the rotary drum.

12. The machine of claim 1, wherein the flexible connection member is expanded and contracted in a direction parallel to a rotational axis of the rotary drum.

13. The machine of claim 1, wherein the heat pump is disposed under the water tub.

14. The machine of claim 13, wherein the heat absorber duct and the heat radiator duct communicate with each other and are horizontally arranged so that the air flows straight therethrough.

15. The machine of claim 13, wherein the heat absorber duct is arranged in a manner that the air flows downwards from an upper portion of the heat absorber to a lower portion of the heat absorber, and wherein a water exhaust opening for draining condensation is formed in a lower portion of the heat absorber duct.

16. The machine of claim 13, further comprising a mounting base for supporting the housing at a certain height, the mounting base accommodating therein the heat pump.

17. The machine of claim 1, wherein the blower is disposed in a corner portion where a top wall and a sidewall of the housing join together above the water tub.

18. The machine of claim 1, further comprising a filter for removing foreign matter from the air, the filter disposed in an upstream of the air flowing in the heat absorber duct.

19. The machine of claim 1, wherein water supplied into the water tub during a washing operation is not remained in the heat absorber duct or the heat radiator duct after the completion of the washing operation.

20. The machine of claim 19, further comprising an air exhaust duct for allowing the air to flow out of the water tub, the air exhaust duct being connected to an inlet of the air guide duct, wherein a portion of the air passageway and/or a portion of the air exhaust duct are/is located at a level higher than a water level of the water in the water tub.

21. The machine of claim 19, wherein the air guide duct is provided with a water exhaust opening for allowing water therein to be drained.

22. The machine of claim 1, wherein the coolant includes a $CO_2$ gas as a main constituent.

23. The machine of claim 1, wherein a rotational axis of the rotary drum is disposed horizontal.

24. The machine of claim 1, wherein a rotational axis of the rotary drum is disposed vertical.

25. The machine of claim 1, further comprising a mounting base for supporting the housing at a certain height, the mounting base accommodating therein the heat pump, wherein the mounting base is drawable from the housing backwards.

26. The machine of claim 1, wherein the flexible connection member and the flexible air exhaust hose extend parallel with each other and downwards along the rear side of the water tub.

27. The machine of claim 1, wherein the flexible connection member and the flexible air exhaust hose extend parallel with each other and extend from the rear side of the water tub substantially perpendicular thereto.

28. The machine of claim 1, wherein the heat pump is disposed at a lower part of a space between a rear wall of the housing and the water tub.

29. A washing and drying machine, comprising:

a water tub elastically supported in a housing;

a rotary drum for holding clothes, the rotary drum being rotatably mounted in the water tub;

a heat pump including a compressor for compressing coolant, a heat radiator for dissipating heat of the compressed coolant, a throttle valve for lowering pressure of the coolant, a heat absorber for allowing the coolant to absorb heat, a pipework for allowing the coolant to circulate through the compressor, the heat radiator, the throttle valve, the heat absorber, a heat absorber duct for allowing air to flow through the heat absorber and a heat radiator duct for allowing the air to flow through the heat radiator;

a blower for forcing the air heated by the heat radiator to flow through an air passageway provided to the water tub into the rotary drum;

an air supply duct for allowing the air to flow into the rotary drum; and an air exhaust duct for allowing the air to flow out of the water tub, wherein the air passageway is connected to an outlet of the heat radiator duct through a flexible connection member; the air exhaust duct is connected to an inlet of the heat absorber duct through another flexible connection member; and the flexible connection members are disposed on the rear side of the water tub and extend in a same direction.

30. A washing and drying machine, comprising:

a water tub elastically supported in a housing;

a rotary drum for holding clothes, the rotary drum being rotatably mounted in the water tub;

a heat pump including a compressor for compressing coolant, a heat radiator for dissipating heat of the compressed coolant, a throttle valve for lowering pressure of the coolant, a heat absorber for allowing the coolant to absorb heat, a pipework for allowing the coolant to circulate through the compressor, the heat radiator, the throttle valve and the heat absorber, a heat absorber duct for allowing air to flow through the heat absorber, and a heat radiator duct for allowing the air to flow through the heat radiator;

an air passageway provided to the water tub for allowing the air to flow into the rotary drum;

a blower for forcing the air heated by the heat radiator to flow through the air passageway into the rotary drum; and a flexible air exhaust hose for allowing the air to flow out of the water tub, wherein the heat radiator duct is connected to the air passageway through a flexible connection member, the flexible connection member is removably attached between the heat radiator duct and the air passageway, the flexible connection member and the flexible air exhaust hose are disposed on the rear side of the water tub and extend in a same direction.

* * * * *